US006062559A

United States Patent [19]

Tanjo et al.

[11] Patent Number: 6,062,559

[45] Date of Patent: May 16, 2000

[54] AUTOMATIC DOCUMENT FEEDER AND CONVEYING BELT MECHANISM OF AUTOMATIC DOCUMENT FEEDER

[75] Inventors: Toru Tanjo; Jun Kusakabe; Hiroshi Kobayashi; Kazuhisa Kondo; Hiroyuki Harada; Masahiro Sako, all of Osaka, Japan

[73] Assignee: Mita Industrial Co., Ltd., Tokyo, Japan

[21] Appl. No.: 09/160,542

[22] Filed: Mar. 25, 1998

[51] Int. Cl.[7] ..... B65H 5/00; B65H 9/04

[52] U.S. Cl. ..... 271/225; 271/246; 271/3.14

[58] Field of Search ..... 271/245, 246, 271/235, 186, 225, 3.14

[56] References Cited

U.S. PATENT DOCUMENTS 4,023,791 5/1977 Hori et al. ..... 271/3 X
4,285,512 8/1981 Shaltz ..... 271/233 X
4,716,440 12/1987 Gouwenberg et al. ..... 355/14 X
4,725,053 2/1988 Bastow et al. ..... 271/229 X
5,655,761 8/1997 Sanchez ..... 271/4.09 X

*Primary Examiner*—Christopher P. Ellis
*Assistant Examiner*—Kenneth W. Bower
*Attorney, Agent, or Firm*—Antonelli, Terry, Stout & Kraus, LLP

[57] ABSTRACT

An automatic document feeder of a type having a document inverting mechanism beside a document sending-in path is disclosed which, when a document located at a document exposure position is to be inverted, operates a conveying belt mechanism in a predetermined direction to convey the document by a predetermined amount in a direction away from a document positioning member, then brings a document positioning member to a retreat position, and then operates the conveying belt mechanism in a direction opposite to the predetermined direction to convey the document to the document inverting mechanism.

1 Claim, 12 Drawing Sheets

AUTOMATIC DOCUMENT FEEDER AND CONVEYING BELT MECHANISM OF AUTOMATIC DOCUMENT FEEDER

FIELD OF THE INVENTION

This invention relates to an automatic document feeder installed in a document processor such as an electrostatic copier, and more specifically, to an automatic document feeder for feeding a document set on document bearing means to an exposure position, and a conveying belt mechanism of the automatic document feeder.

DESCRIPTION OF THE PRIOR ART

In recent years, with the speeding and automation of copying, copiers have been equipped with an automatic document feeder which automatically feeds a plurality of documents, set at a document setting position of a document bearing plate, sequentially to a document exposure position on top of a transparent platen. This type of automatic document feeder comprises document bearing means for bearing documents; document supplying means for supplying the documents, set on the document bearing means, to a document feeding path; a register roller pair disposed downstream of the document supplying means to temporarily stop the document carried by the document supplying means and carry the stopped document toward a document exposure position; document conveying means for conveying the document, carried by the register roller pair, to the document exposure position; and document discharge means for returning the document having finished exposure at the document exposure position on a transparent platen onto the document bearing means.

To bring the back and face of a document to be double-side copied to the exposure position alternately in such an automatic document feeder, document inverting means is provided for inverting the document. The document inverting means comes in a type provided beside a document sending-in path, and a type provided beside the document discharge means. The type of document inverting means provided beside the document sending-in path is advantageous over the type provided beside the document discharge means in terms of a smaller amount of document transport.

Since a document exposure reference position on the transparent platen is provided at an end of the transparent platen beside the document sending-in path, however, a document positioning member upwardly protruding from the top of the transparent platen is disposed between the transparent platen and the document sending-in path. To locate the document at the document exposure position, the rear end of the document is caused to slightly overrun the document positioning member, and then the document is carried in the reverse direction to bring the rear end of the document into contact with the document positioning member. With the type of document inverting means provided beside the document sending-in path, the document positioning member is designed to be retreated downwardly of the top of the transparent platen at the time of document inversion. If the document positioning member is so movable upward and downward, a clearance is formed between the document positioning member and the transparent platen. Thus, when the rear end of the document is contacted with the document positioning member in locating the document at the document exposure position, the document which is a very thin paper or an unusual paper, such as a curled paper, may have its front end pinched in the clearance between the document positioning member and the transparent platen. Even when the rear end of the document is contacted with the document positioning member during the positioning of the document without its front end being pinched in the clearance between the document positioning member and the transparent platen, the front end of the document may be pinched in the clearance between the document positioning member and the transparent platen because of friction between the document support plate and the document when the document positioning member is moved downward during document inversion. A document inverting action, if performed with the front end of the document pinched in the clearance between the document positioning member and the transparent platen, would result in the breakage of the document.

A so-called recirculating automatic document feeder has also been put to practical use in which a document returned onto the document bearing plate is moved again to a document setting position of the document bearing plate by actuating a moving plate of document moving means, so that the document can be treated again.

With the above-mentioned recirculating automatic document feeder, when the moving plate of the document moving means recedes after the documents returned onto the document bearing plate are moved again to the document setting position by the document moving means, the upper document may be displaced to the document discharge side, i.e., the upstream side in a document feeding direction. In detail, such a document feeder may be configured such that the position of the document bearing plate is made low and its delivery portion on the downstream side in the document feeding direction is inclined in order to keep the height of the automatic document feeder low while ensuring a somewhat large curvature of the document feeding path. If some air is present between the documents of the document stack moved again by the moving plate of the document moving means to the document setting position, the documents are prone to move. When the moving plate of the document moving means recedes in this state, the upper document is displaced upstream in the document feeding direction. At the front end of the document setting position, a document stopper is provided. A stopper portion of the document stopper is generally provided so as to be inclined toward the upstream side in the document feeding direction, with its upper end coming most upstream. When the documents moved by the moving plate of the document moving means to the document setting position are contacted with the stopper portion of the document stopper, the upper document is warped. When the moving plate of the document moving means recedes in this condition, the documents spring because of an elastic force ascribed to the above-mentioned warp, whereupon the upper document is displaced upstream in the document feeding direction. This displacement of the document moved to the document setting position becomes the cause of a failure in document supply.

The document conveying means in the automatic document feeder is composed of a conveying belt mechanism comprising a driving roller and a driven roller disposed above the transparent platen at spaced locations in a document feeding direction, an endless conveying belt looped over the driving roller and the driven roller, and a plurality of pressing rollers disposed between the driving roller and the driven roller and pressing the endless conveying belt against the transparent platen. To prevent the endless conveying belt from moving axially of the driving roller and the driven roller and leaning to the roller ends in the above conveying belt mechanism, it has been customary practice to use belt guides mounted on both sides of the driven roller so as to rotate together with the driven roller, the belt guides having flange portions with a larger diameter than the outer diameter of the driven roller.

To restrain the sideways leaning of the endless conveying belt reliably by the flange portions of the belt guides, it is necessary to make their outside diameter much larger than the outside diameter of the driven roller. For this purpose, the driven roller must be disposed at a considerably high position above the top of the transparent platen. A large distance from the transparent platen to the driven roller causes the following problem: When a document of a large size such as A3 is located at the document exposure position on the transparent platen, an end portion of the document beside the driven roller is markedly curled toward the driven roller. This curled portion appears as a shadow during exposure, adversely affecting a copy. If the driven roller is lowered in position and brought close to the transparent platen in order to solve this problem, the outside diameter of the flange portions of the belt guides is decreased, and the endless conveying belt passes over the flange portion. Thus, the function of preventing the sidewise leaning of the endless conveying belt cannot be fulfilled.

SUMMARY OF THE INVENTION

A first object of the present invention is to provide an automatic document feeder which can invert a document without its breakage even when the end of the document located at the exposure position on the transparent platen is pinched in the clearance between the document positioning member and the transparent platen.

A second object of the invention is to provide an automatic document feeder in which when a document returned onto the document bearing plate is moved again to the document setting position by actuating the moving plate of the document moving means, and then the moving plate of the document moving means recedes, the document is not displaced.

A third object of the invention is to provide a conveying belt mechanism of an automatic document feeder which can reliably prevent the sidewise leaning of the endless conveying belt even when the driven roller is disposed at a position close to the transparent platen.

To attain the first object, the invention provides an automatic document feeder comprising document bearing means for bearing documents; document supplying means for supplying the documents set on the document bearing means; a document sending-in path for guiding the document supplied by the document supplying means onto a transparent platen; a register roller pair disposed beside the document sending-in path for temporarily stopping the document carried by the document supplying means and carrying the stopped document toward a position on the transparent platen; document conveying means for conveying the document carried by the register roller pair to a document exposure position on the transparent platen; document inverting means for turning the document conveyed onto the transparent platen upside down, and carrying the inverted document onto the transparent platen through the document sending-in path; a document positioning member disposed between the document sending-in path and the transparent platen and movable between a restraint position at which it protrudes upwardly of the top of the transparent platen, and a retreat position at which it comes downwardly of the top of the transparent platen; positioning member actuating means for bringing the document positioning member to the restraint position and the retreat position; and control means for controlling the document supplying means, the register roller pair, the document conveying means, the document inverting means, and the positioning member actuating means; wherein when the document located at the document exposure position is to be inverted, the control means operates the document conveying means in a predetermined direction to convey the document by a predetermined amount in a direction away from the document positioning member, then operates the positioning member actuating means to bring the document positioning member to the retreat position, and then operates the document conveying means in a direction opposite to the predetermined direction to convey the document to the document inverting means.

To attain the second object, the invention provides an automatic document feeder adapted to send a document set at a document setting position of a document bearing plate for bearing documents to a document feeding path, and return the document onto the document bearing plate after feeding the document along the document feeding path; wherein the automatic document feeder includes document moving means having a moving plate for moving the document returned onto the document bearing plate to the document setting position, document pressing means for pressing the document moved by the document moving means to the document setting position, and control means for controlling the operation of the document pressing means and the document moving means, and the control means operates the moving plate of the document moving means to move the document returned onto the document bearing plate to the document setting position, then operates the document pressing means to press the document moved to the document setting position, and causes the moving plate of the document moving means to recede while maintaining the document in a pressed state.

Desirably, the control means maintains the pressed state by the document pressing means until a predetermined period of time has elapsed since the moving plate of the document moving means recedes to a predetermined position. The document pressing means may be set document pressing means which presses the document when the document set at the document setting position of the document bearing plate is sent to the document feeding path. The document bearing plate is constituted such that its sending portion on the downstream side in a document feeding direction is inclined upward.

To attain the second object, the invention provides a conveying belt mechanism of an automatic document feeder for conveying a document placed on document bearing means and supplied toward a transparent platen to a document exposure position on the transparent platen, the conveying belt mechanism comprising a driving roller and a driven roller disposed above the transparent platen with a predetermined spacing provided between each other in a document feeding direction, an endless conveying belt looped over the driving roller and the driven roller, a plurality of pressing rollers disposed between the driving roller and the driven roller for pressing the endless conveying belt against the transparent platen, and belt guides mounted at both ends of the driven roller, the belt guides each comprising a boss portion mounted on a rotating shaft of the driven roller so as to be capable of relative rotation, a detachment preventing portion provided so as to protrude from the boss portion diametrically beyond an outer peripheral surface of the driven roller and having a front end bent inwardly, and a rotation stopping portion provided in the boss portion, the rotation stopping portion being engaged with a rotation restraining member.

The belt guide has a flange portion provided so as to protrude from the boss portion diametrically beyond the outer peripheral surface of the driven roller at least over an angular range corresponding to a range in which the endless conveying belt is wound on the driven roller, and the detachment preventing portion is provided in the flange portion. On the boss portion, a contact ring which an edge of the endless conveying belt contacts is mounted rotatably. This contact ring is desirably composed of a plastic material.

DETAILED DESCRIPTION OF THE PREFERRED EMBODIMENTS

Preferred embodiments of an automatic document feeder having a document separating mechanism constructed in accordance with the present invention will be described in detail by reference to the accompanying drawings.

Figure 1:
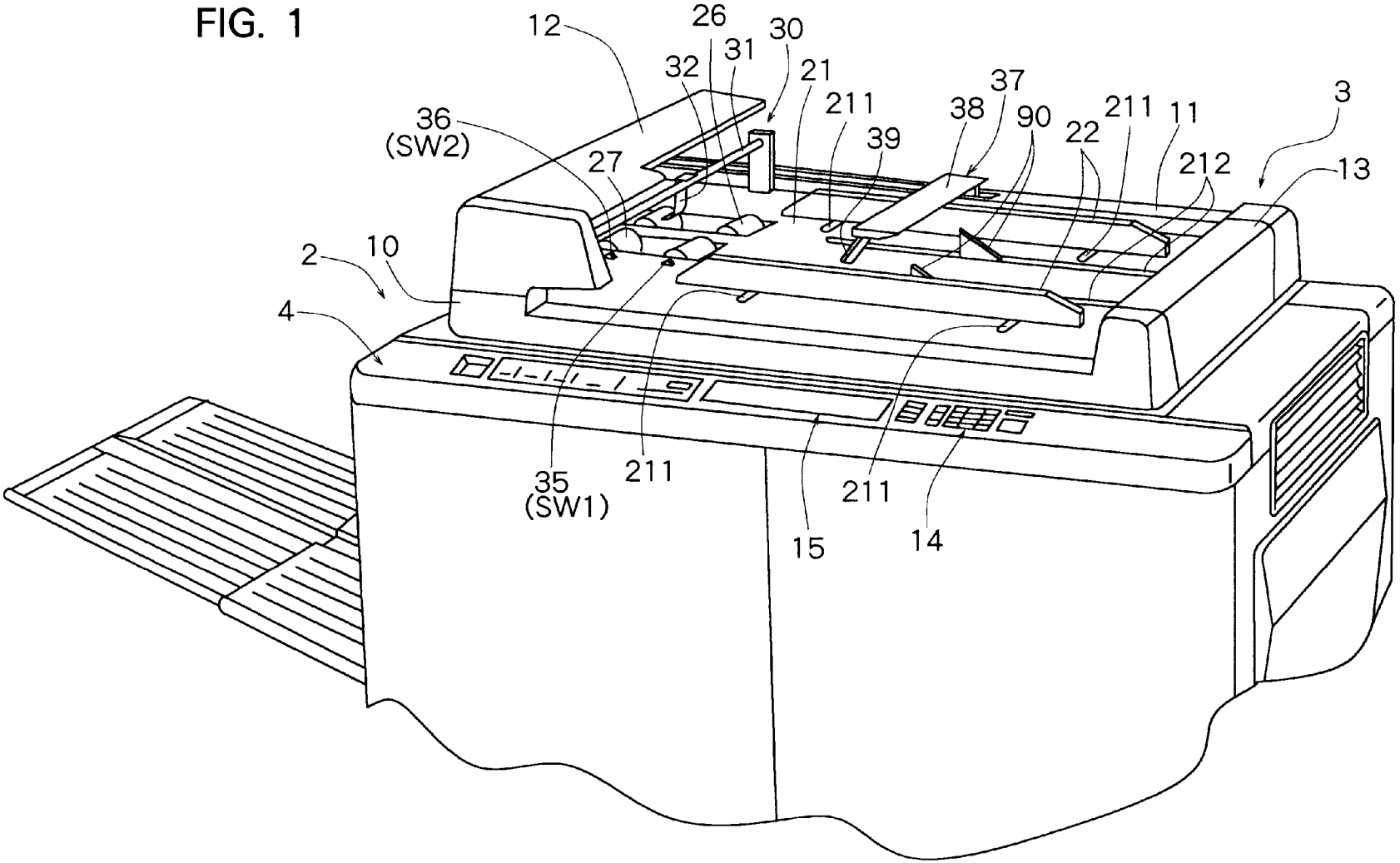
FIG. 1 is a perspective view showing a state in which an automatic document feeder constructed in accordance with the present invention is mounted on an electrostatic copier.
Figure 2:
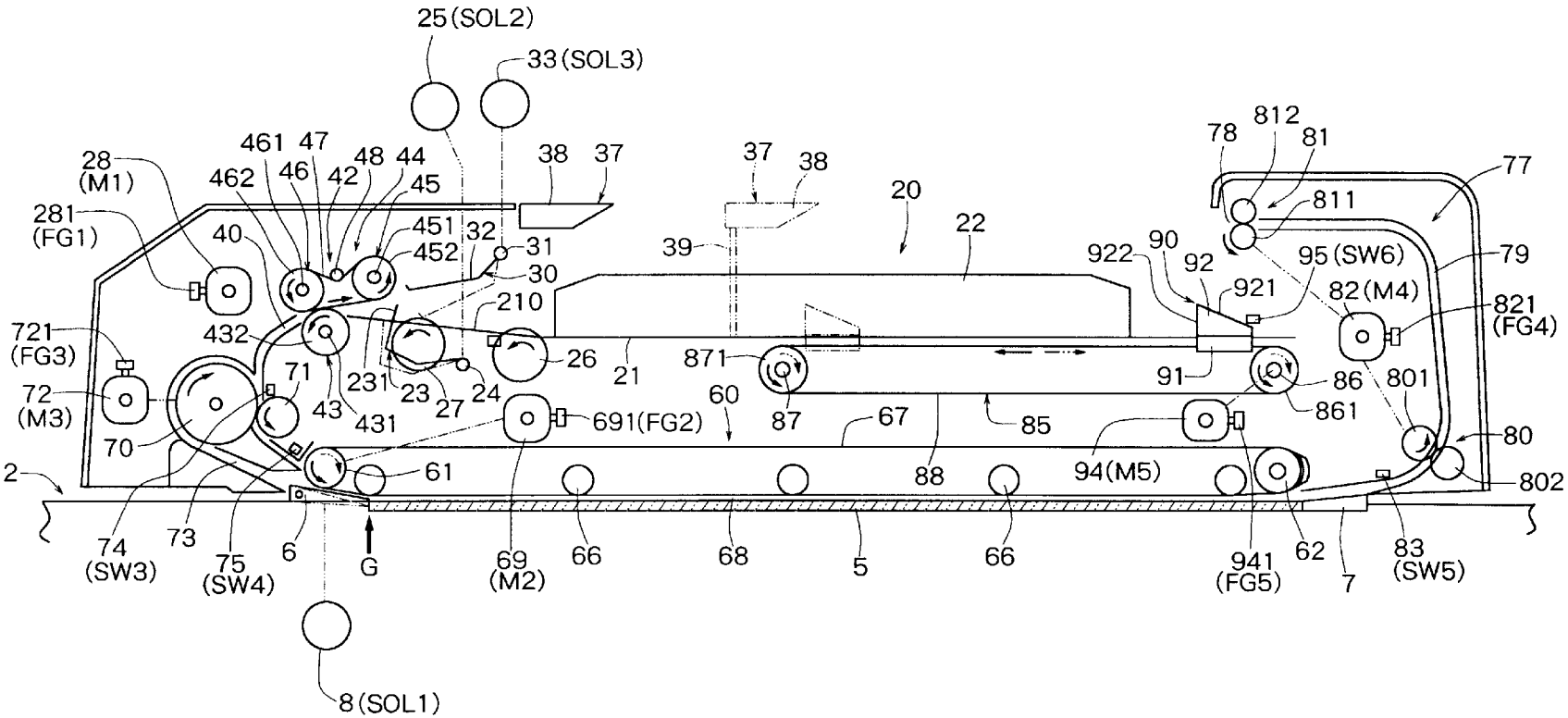
FIG. 2 is a sectional schematic view of the automatic document feeder shown in FIG. 1.

FIGS. 1 and 2 illustrate an upper end portion of an electrostatic copier 2, and an automatic document feeder 3 mounted thereon. The electrostatic copier 2 has a housing 4, on top of which a transparent platen 5 (FIG. 2), optionally a glass plate, is disposed. On one side of the transparent platen 5 (the left-hand side in FIG. 2), a document positioning member 6 which determines a document exposure reference position G, is disposed. On the other side thereof (the right-hand side in FIG. 2), a stationary mounting member 7 is disposed. The document positioning member 6 is movable between a restraint position indicated by a solid line in FIG. 2 and a retreat position indicated by a two-dot chain line in FIG. 2. When located at the restraint position, the document positioning member 6 has its front restraining edge (a right edge in FIG. 2) protruded upwardly of the top of the transparent platen 5. When located at the retreat position, its front restraining edge is brought downwardly of the top of the transparent platen 5. This document positioning member 6 is actuated by a solenoid 8 (SOL1) as positioning member actuating means. When the solenoid 8 (SOL1) is deenergized, the document positioning member 6 is located at the operating position. When the solenoid 8 (SOL1) is energized, the document positioning member 6 is brought to the retreat position.

The automatic document feeder 3 constructed in accordance with the present invention is mounted on the top of the housing 4 of the electrostatic copier 2 so as to be openable and closable about a pivot axis extending along a rear side edge of the transparent platen 5. If a document is to be laid manually on the transparent platen 5 of the electrostatic copier 2, the automatic document feeder 3 is turned upward from the illustrated closed position to expose the transparent platen 5, and the document is placed at a required position on the transparent platen 5. Then, the automatic document feeder 3 is brought to the illustrated closed position to cover the transparent platen 5 and the document placed thereon. In laying the document on the transparent platen 5, one can locate the document at an exposure position by contacting one edge of the document with the front restraining edge of the document positioning member 6 to bring the one edge of the document to the document exposure reference position G. When the automatic document feeder 3 is used to force documents automatically onto the transparent platen 5 and force them automatically out from there, the automatic document feeder 3 is put to the illustrated closed position.

The illustrated automatic document feeder 3 includes a front cover 10 and a rear cover 11 disposed at spaced apart locations in a front-to-back direction (the direction perpendicular to the sheet surface in FIG. 2). The front cover 10 and the rear cover 11 may be formed of a suitable plastic material. Inside the rear cover 11, a rear supporting base plate (not shown) is disposed. The rear supporting base plate is mounted, via a mounting mechanism (not shown) optionally of a well-known shape per se, on the top of the housing 4 of the electrostatic copier 2 so as to be openable and closable. Various constituent elements of the automatic document feeder 3 are supported directly or indirectly by the rear supporting base plate. Between left end portions of the front cover 10 and the rear cover 11, a left end portion cover 12 is disposed. Between right end portions of the front cover 10 and the rear cover 11, a right end portion cover 13 is disposed. On the top of the housing 4 and on the side nearer to the operator, operating means 14 and display means 15 are disposed. The operating means 14 has copy action performing keys such as a copy start key, a copy number designation key, a double-sided copying designation key, and a copy action stop key, and enters copying information into control means (to be described later on) of the electrostatic copier 2. The display means 15 displays copying information, failure information, etc.

Between the front cover 10 and the rear cover 11, document bearing means 20 is disposed. The document bearing means 20 is defined by a document bearing plate 21 formed of a plastic material. The document bearing plate 21, in the illustrated embodiment, has a left end portion (on a downstream side in a document feeding direction) in FIG. 2, i.e., a delivery portion 210, formed so as to be inclined upward. In a central part of the document bearing plate 21, a pair of width restricting members 22 are mounted so as to be movable in a width direction along guide channels 211 provided in the document bearing plate 21. The pair of width restricting members 22 are joined together, via a rack and pinion mechanism (not shown) well known per se, below the document bearing plate 21, and are moved toward and away from each other in an interlocked manner.

At the front end, at a setting position, of the document bearing plate 21 constituting the document bearing means 20, a document stopper 23 is disposed so as to be movable between a stop position at which it contacts the front end of the document placed on the document bearing plate 21 at the time of document setting, and a retreat position at which it permits the carriage of the document placed at the document setting position. The document stopper 23 is disposed below the document bearing plate 21, with its base end being fixed to a turning shaft 24 disposed in the width direction (the direction perpendicular to the sheet face in FIG. 2), and its front end being located through an opening formed in the document bearing plate 21. A front end portion of the document stopper 23 protruding upwardly of the document bearing plate 21 constitutes a stopper portion 231 formed so as to be inclined toward the upstream side in the document feeding direction (rightward in FIG. 2), with its upper end coming most upstream. The turning shaft 24 having the document stopper 23 attached thereto is actuated by a solenoid 25 (SOL2). The document stopper 23 attached to the turning shaft 24 actuated by the solenoid 25 (SOL2) is positioned at the stop position indicated by a solid line in FIG. 2 when the solenoid 25 (SOL2) is deenergized, and brought to the retreat position indicated by a two-dot chain line in FIG. 2 when the solenoid 25 (SOL2) is energized.

Below the front end portion of the document bearing plate 21 constituting the document bearing means 20, two forwarding rollers 26 and 27 are disposed which constitute document supplying means. The forwarding rollers 26 and 27 are disposed at spaced locations in the document feeding direction (the right-to-left direction in FIG. 2), and partially protrude upwardly through openings formed in the document bearing plate 21. These forwarding rollers 26 and 27 are transmittingly connected to an electric motor 28 (M1) via a power transmission mechanism (not shown), and rotationally driven in a direction shown by arrows in FIG. 2. To the electric motor 28 (M1) is mounted rotational amount detecting means 281 (FG1), such as a rotary encoder or a frequency generator, which constitutes a means of detecting the amount of document conveyance. Pulse signals as detection signals therefrom are sent to control means (to be described later). Above the forwarding roller 27 on the downstream side in the feeding direction (the left-hand side in FIG. 2) among the two forwarding rollers, document pressing means 30 is disposed. The document pressing means 30 has a turning shaft 31 disposed in the width direction (the direction perpendicular to the sheet face in FIG. 2), and a pressing plate 32 having one end fixed to the turning shaft 31 and the other end acting on a set document laid on the document bearing plate 21 above the forwarding roller 26. The turning shaft 31 constituting the document pressing means 30 is actuated by a solenoid 33 (SOL3). The pressing plate 32 attached to the turning shaft 31 actuated by the solenoid 33 (SOL3) is positioned at a retreat position indicated by a solid line in FIG. 2 when the solenoid 33 (SOL3) is deenergized, and brought to a pressing position indicated by a two-dot chain line in FIG. 2 when the solenoid 33 (SOL3) is energized.

Axially forward of the forwarding roller 26 located on the upstream side in the feeding direction (the right-hand side in FIG. 2) among the two forwarding rollers, a presetting switch 35 (SW1) is disposed, as shown in FIG. 1 for detecting that a document has been laid on the document bearing plate 21. The presetting switch 35 (SW1) becomes ON when a document is laid on the document bearing plate 21 by an operator, and sends an ON signal to the control means (to be described later on). This control means drives the electric motor 28 (M1) to turn the forwarding rollers 26 and 27. By turning the forwarding rollers 26 and 27, the document laid on the document bearing plate 21 is carried toward the downstream side in the document feeding direction (leftward in FIG. 2). Axially forward of the forwarding roller 27 located on the downstream side in the feeding direction (the left-hand side in FIG. 2) between the two forwarding rollers, a setting switch 36 (SW2) is disposed. The setting switch 36 (SW2) becomes ON when acted on by the front end of the document that has been laid on the document bearing plate 21 as described above and carried by the forwarding rollers 26 and 27. Upon this action, the setting switch 36 (SW2) sends an ON signal to the control means (to be described later on). The control means stops the driving of the electric motor 28 (M1) when a predetermined period of time has passed since the setting switch 36 (SW2) was turned on. As a result, the document laid on the document bearing plate 21 has its front end in contact with the stopper portion 231 of the document stopper 23, whereby it is set at a predetermined setting position. When the document has been set at the predetermined setting position of the document bearing plate 21 and the copy start key of the operating means 14 is depressed, the solenoid 25 (SOL2) is energized as shown in FIG. 2 to bring the document stopper 23 to the retreat position. Also, the solenoid 33 (SOL3) is energized to bring the pressing plate 32 of the document pressing means 30 to the pressing position. Then, the electric motor 28 (M1) is driven to rotationally drive the forwarding rollers 26 and 27. By this measure, the document D placed on the document bearing plate 21 is supplied toward a document sending-in path 40 constituting a document feeding path (to be described later on).

The automatic document feeder 3 in the illustrated embodiment has a partition unit 37 to be moved, where necessary, along the rear cover 11. The partition unit 37 includes a support member 38 moved along the rear cover 11, and a partition member 39 having a base end pivotably supported by the support member 38. The support member 38, when no document carrying action is done, is located at a home position indicated by a solid line in FIG. 2. When the copy start key 15 is pressed, the support member 38 is moved by drive means (not shown) over a distance corresponding to the size of the document set on the document bearing plate 21 to the upstream side in the document feeding direction (rightward in FIG. 2) as shown by a two-dot chain line. The partition member 39 is moved between a non-operating state retreated into the support member 38, and an operating state in which its front end acts on the document bearing plate 21 or the document set on the document bearing plate 21 as shown by a two-dot chain line in FIG. 2. The partition member 39 is adapted to be actuated by a solenoid (not shown). When the solenoid is deenergized, the partition member 39 is held in the non-operating state; when the solenoid is energized, the partition member 39 comes into the operating state. During the document feeding action, the partition member 39 is brought into the operating state. In this state, the partition member 39, as shown in FIG. 2, restrains the front ends of the documents returned onto the document bearing plate 21 by document discharge means (to be described later on) to arrange the documents and separate the documents that have not been fed and that have been returned.

The automatic document feeder 3 in the illustrated embodiment has a document sending-in path 40 for guiding the document, which has been sent by the forwarding rollers 26 and 27, to the transparent platen 5. Between the document sending-in path 40 and the document stopper 23, document separating means 42 is disposed. The document separating means 42 comprises a separating roller 43, and a separating belt mechanism 44 disposed opposite and above the separating roller 43. The separating roller 43 comprises a rotating shaft 431, and a plurality of (e.g. two) rollers 432 mounted on the rotating shaft 431 and provided at spaced locations. The roller 432 is formed of urethane rubber, is disposed below a guide plate constituted integrally with the document bearing plate 21, and is causes to protrude upward through an opening formed in the guide plate. The rotating shaft 431 having the rollers 432 mounted thereon is transmittingly connected to the electric motor 28 (M1) via a power transmission mechanism (not shown), whereby it is rotationally driven in a direction shown by an arrow in FIG. 2.

The separating belt mechanism 44 includes a driving roller 45, a driven roller 46 disposed parallel to the driving roller 45 with spacing, a wide separating belt 47 wound between the driving roller 45 and the driven roller 46, and a tension roller 48 for pressing an upper surface of the separating belt 47. The driving roller 45 comprises a rotating shaft 451, and a roller 452 mounted on the rotating shaft 451 and formed of an elastic resin such as urethane rubber. The rotating shaft 451 is transmittingly connected to the electric motor 28 (M1) via the power transmission mechanism (not shown), whereby it is rotationally driven in a direction shown by an arrow in FIG. 2. The driven roller 46 comprises a support shaft 461, and a roller 462 rotatably mounted on the support shaft 461 and formed of polyacetal resin. The separating belt 47 is composed of an endless belt comprising a rubber-coated cloth. The tension roller 48 has both end portions rotatably supported by pressing mechanisms (not shown), and presses the upper surface of the separating belt 47. In the so constituted separating belt mechanism 44, when the driving roller 45 is rotationally driven by the electric motor 28 (M1) in the direction shown by the arrow in FIG. 2, the separating belt 47 is operated in a direction shown by an arrow in FIG. 2.

In the document separating means 42 constructed as above, the separating roller 43 is rotationally driven in the direction shown by the arrow in FIG. 2, and the separating belt 47 is operated in the direction shown by the arrow in FIG. 2, whereby only the bottommost document is separated from the document stack sent by the forwarding rollers 26 and 27 and carried into the document sending-in path 40.

With further reference to FIG. 2, a conveying belt mechanism 60 constituting the document conveying means is disposed below the document bearing means 20. This conveying belt mechanism 60 will be explained by reference to FIGS. 3 and 4 as well. The conveying belt mechanism 60 includes a driving roller 61 and a driven roller 62 disposed above the transparent platen at spaced locations in a a feeding direction (the left-to-right direction in FIG. 2), an endless conveying belt 67 looped over the driving roller 61 and the driven roller 62, and a plurality of pressing rollers 66 disposed between the driving roller 61 and the driven roller 62 and urging the endless conveying belt 67 to press it against the transparent platen 5. A lower running portion of the endless conveying belt 67 extends along the transparent platen 5 of the electrostatic copier 2. Between this lower running portion and the transparent platen 5, a document transport path 68 is defined which constitutes a document feeding path. The driving roller 61 of the thus constituted conveying belt mechanism 60 is transmittingly connected to the electric motor 69 (M2) via a power transmission mechanism (not shown), and is rotationally driven in the normal direction of rotation shown by a solid arrow and in the reversed direction of rotation shown by a dashed arrow in FIG. 2. To the electric motor 69 (M2) is mounted rotational amount detecting means 691 (FG2), such as a rotary encoder or a frequency generator, which constitutes a means of detecting the amount of document conveyance. Pulse signals as signals for indicating detection thereby are sent to the control means (to be described later on).

The driven roller 62 is composed of a cylindrical roller portion 621 formed of an aluminum alloy, boss portions 623, 623 formed at both ends of the roller portion 621 integrally via a plurality of ribs 622, 622, and rotating shafts 625, 625 forced into shaft fitting holes 623*a*, 623*a* provided in the boss portions 622, 622. The so constituted driven roller 62 has its rotating shafts 625, 625 rotatably supported by adjusting support plates 63, 63 via bearings 63*a*, 63*a*. To the adjusting support plates 63, 63, guide pins 631, 631 are attached, and narrow guide grooves 632, 632 are formed in the adjusting support plates 63, 63 in the document feeding direction (the right-to-left direction in FIG. 4). The so constituted adjusting support plates 63, 63 are mounted on a front supporting base plate 17 and a rear supporting base plate 18 so as to be movable in the document feeding direction (the right-to-left direction in FIG. 4). To the front supporting base plate 17 and the rear supporting base plate 18, guide pins 171 and 181 are attached in correspondence with the guide grooves 632, 632 provided in the adjusting support plates 63, 63. Also, guide grooves 172 and 182 are formed in the front supporting base plate 17 and rear supporting base plate 18 in correspondence with the guide pins 631, 631 attached to the adjusting support plates 63, 63. The guide pins 631, 631 are passed through the guide grooves 172, 182, respectively, while the guide pins 171, 181 are passed through the guide grooves 632, 632, respectively. Between the guide pins 631, 631 and the guide pins 171, 181, helical tension springs 191, 191 are stretched. These helical tension springs 191, 191 act in such a manner as to move the adjusting support plates 63, 63 rightward in FIG. 4. Thus, a predetermined tension is exerted on the endless conveying belt 67 wound on the driven roller 62 supported by the adjusting support plates 63, 63.

At both ends of the driven roller 62, belt guides 64, 64 are mounted. The belt guides 64, 64 comprise boss portions 641, 641 mounted relatively rotatably on the rotating shafts 625, 625 and having holes 641*a*, 641*a*, flange portions 642, 642 formed so as to protrude from the outside surfaces of the boss portions 641, 641 diametrically beyond the outer peripheral surface of the driven roller 62, detachment preventing portions 643, 643 comprising right-hand parts (in FIGS. 3 and 4) of the flange portions further protruding diametrically and having front ends bent inward, i.e., toward the endless conveying belt 67, and rotation stopping portions 644, 644 provided in the boss portions 641, 641 on the side opposite to the detachment preventing portions 643, 643. The belt guides 64, 64 are each integrally molded from a suitable plastic material. The flange portions 642, 642 are each formed at least over an angular range (about 240° in the illustrated embodiment) corresponding to an angular range (about 180°) in which the endless conveying belt 67 is wound on the driven roller 62. The detachment preventing portions 643, 643 are provided in the center of the flange portions 642, 642. The rotation stopping portions 644, 644 of the belt guides 64, 64 have end faces 644*a*, 644*a* formed as flat surfaces. These end faces 644*a*, 644*a* are engaged with a rotation restraining member 630 attached to the adjusting support plates 63, 63 by means of screws 630*b*, 630*b*. The belt guides 64, 64 in the illustrated embodiment are constituted as described above, and the detachment preventing portions 643, 643 are provided in the flange portions 642, 642. Thus, the endless conveying belt 67 does not pass over the flange portions 642, 642 to lean to one side. This obviates the need to form the flange portions 642, 642 to have a diametrically large size. Hence, the driven roller 62 can be disposed at a position close to the transparent platen 5. In the illustrated embodiment, moreover, contact rings 65, 65 composed of a plastic material with a small coefficient of friction are rotatably mounted on the boss portions 641, 641. These contact rings 65, 65 rotate upon the contact of the edge of the endless conveying belt 67 with the inner surface of the contact ring, thereby reducing the contact resistance of the endless conveying belt 67.

Figure 3:
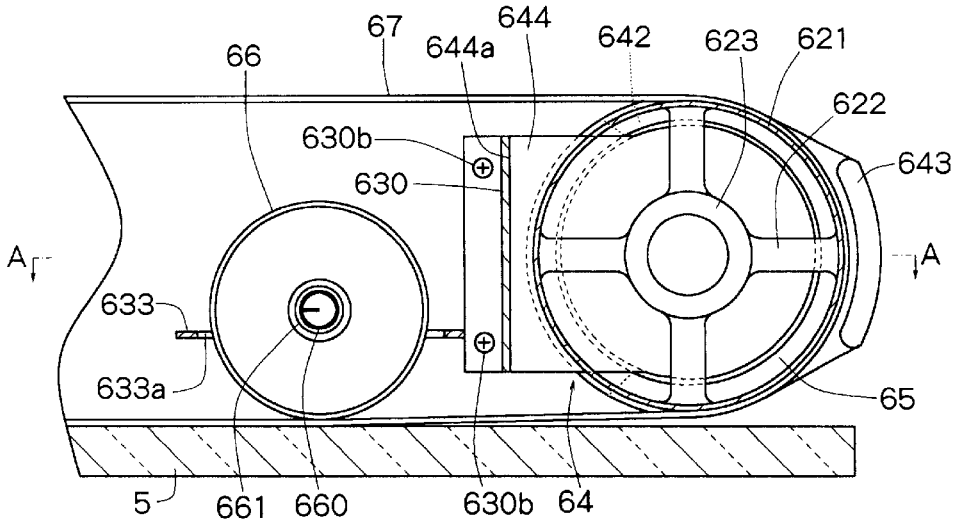
FIG. 3 is a sectional view of the essential part of a conveying belt mechanism constituting the automatic document feeder shown in FIG. 1.
Figure 4:
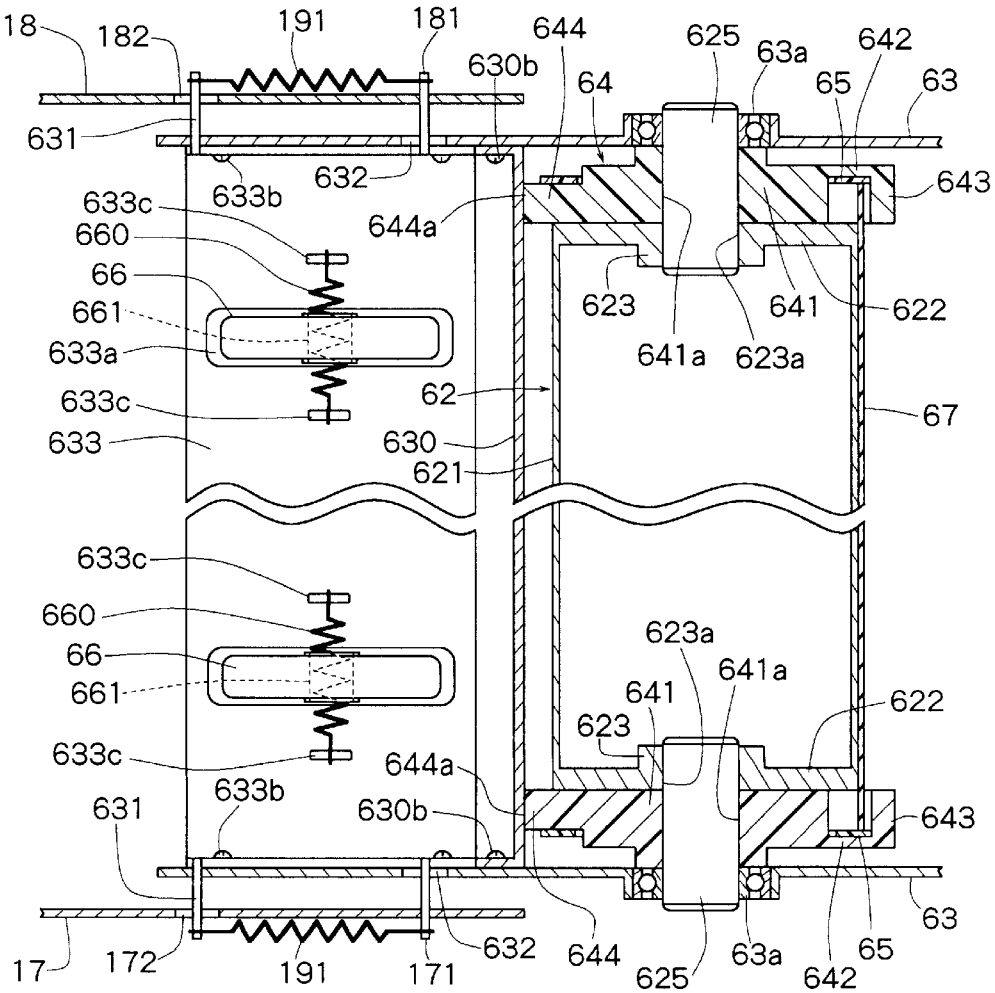
FIG. 4 is a sectional view taken on line A—A in FIG. 3.

Next, a support structure for the pressing roller 66 disposed near the driven roller 62 will be described by reference to FIGS. 3 and 4. Between the adjusting support plates 63, 63 having the driven roller 62 mounted thereon, a pressing roller mounting plate 633 is attached by means of screws 633*b*. In the pressing roller mounting plate 633, a plurality of openings 633*a* are formed with spacing in the width direction (the vertical direction in FIG. 4). Through these openings 633*a*, the pressing rollers 66 are disposed. That is, the pressing roller 66 is elastically supported by passing a helical spring 660 through a hole formed in the center of the pressing roller 66, and engaging both ends of the helical spring 660 with engaging portions 633*c*, 633*c* provided on both sides of the opening 633*a* of the pressing roller mounting plate 633. The so elastically supported pressing roller 66 is rotatable, and urges the endless conveying belt 67 so as to press it toward the transparent platen S. The pressing rollers 66 other than the pressing rollers 66 disposed near the driven roller 62 are supported by a support structure similar to the pressing roller mounting plate (not shown) disposed between the front supporting base plate 17 and the rear supporting base plate 18.

Along the document sending-in path 40 formed between the document separating means 42 and the document transport path 68, an inverting/register roller 70 and a register roller 71 are disposed in contact with each other. The inverting/register roller 70 is transmittingly connected to an electric motor 72 (M3) via a power transmission mechanism (not shown), and is rotationally driven in a direction shown by an arrow in FIG. 2. To the electric motor 72 (M3) is mounted rotational amount detecting means F721 (FG3), such as a rotary encoder or a frequency generator, which constitutes a means of detecting the amount of document conveyance. Pulse signals as signals for indicating detection thereby are sent to the control means (to be described later on). The register roller 71 is driven upon contact with the inverting/register roller 70 to function as a driven roller. Around the inverting/register roller 70, a document inverting path 73 is formed in communication with the document transport path 68 and the document sending-in path 40. Upstream and downstream from the inverting/register roller 70 and the register roller 71 in the document sending-in path 40, reflection type optical document detectors 74 (SW3) and 75 (SW4) are disposed which comprise a light emitting element and a light receiving element. These document detectors 74 (SW3) and 75 (SW4) detect a document passing through the document sending-in path 40, and issue detection signals to the control means (to be described later on).

On the right of the document transport path 68, document discharge means 77 is disposed. The document discharge means 77 has a document sending-out path 79 which constitutes a document feed path formed between the document transport path 68 and a document exit 78 provided above the upstream end in the document feeding direction of the document bearing plate 21. Along the document sending-out path 79, a document conveying roller pair 80 is disposed which comprises a driving roller 801 and a driven roller 802. Beside a downstream end in the document feeding direction of the document sending-out path 79, a document discharge roller pair 81 is disposed which comprises a driving roller 811 and a driven roller 812. The driving rollers 801 and 811 of the document conveying roller pair 80 and document discharge roller pair 81 are transmittingly connected to an electric motor 82 (M4) via a power transmission mechanism (not shown), and are rotationally driven in directions shown by arrows in FIG. 2. To the electric motor 82 (M4) is mounted rotational amount detecting means F821 (EG4), such as a rotary encoder or a frequency generator, which constitutes a means of detecting the amount of document conveyance. Pulse signals as signals for indicating detection thereby are sent to the control means (to be described later on). In the illustrated embodiment, a reflection type optical document detector 83 (SW5) comprising a light emitting element and a light receiving element is disposed upstream from the document conveying roller pair 80 in the document sending-out path 79. This detector 83 (SW5) detects a document passing through the document sending-out path 79, and issues a detection signal to the control means (to be described later on).

The automatic document feeder 3 in the illustrated embodiment has document moving means 85 in relation to the document exit 78. The document moving means 85 is disposed below the document bearing plate 21. The document moving means 85 includes a driving shaft 86 and a driven shaft 87 disposed with spacing in the document feeding direction. To the driving shaft 86, two pulleys 861 are fixed with a suitable spacing in the axial direction. Similarly, two pulleys 871 are fixed to the driven shaft 87 with a suitable spacing in the axial direction. Between the pulleys 861 and 871 pairing up with each other, endless moving belts 88 are wound. To an upper running portion of each of the endless moving belts 88, a moving plate 90 is fixed. Each of the moving plates 90 has a base portion 91 fixed to the endless moving belt 88, and a document moving portion 92 protruding upward from the base portion 91. An upstream guide surface 921 of the document moving portion 92 is inclined upwardly at an angle of inclination of, say, about 35 degrees toward the downstream side in the document feeding direction. A downstream pressing surface 922 of the document moving portion 92 is formed as a cliff-like surface, which may be substantially vertical, in the illustrated embodiment. The driving shaft 86 is transmittingly connected to an electric motor 94 (M5) via a suitable power transmission mechanism. The electric motor 94 (M5), where necessary, rotationally drives the driving shaft 86 in normal and reversed directions to drive the endless moving belt 88, thereby reciprocating the moving plate 90, where necessary, between a receding position (home position) shown by a solid line and a maximally advancing position shown by a two-dot chain line in FIG. 2, in correspondence with the size of the document. To the electric motor 94 (M5) is mounted rotational amount detecting means F941 (FG5), such as a rotary encoder or a frequency generator, which constitutes a means of detecting the amount of document conveyance. Pulse signals as signals for indicating detection thereby are sent to the control means (to be described later on). At the receding position of the moving plate 90, a home position sensor 95 (SW6) is disposed for detecting that the moving plate 90 has been located at the receding position (home position). The home position sensor 95 (SW6) issues a detection signal to the control means (to be described later on).

Figure 7:
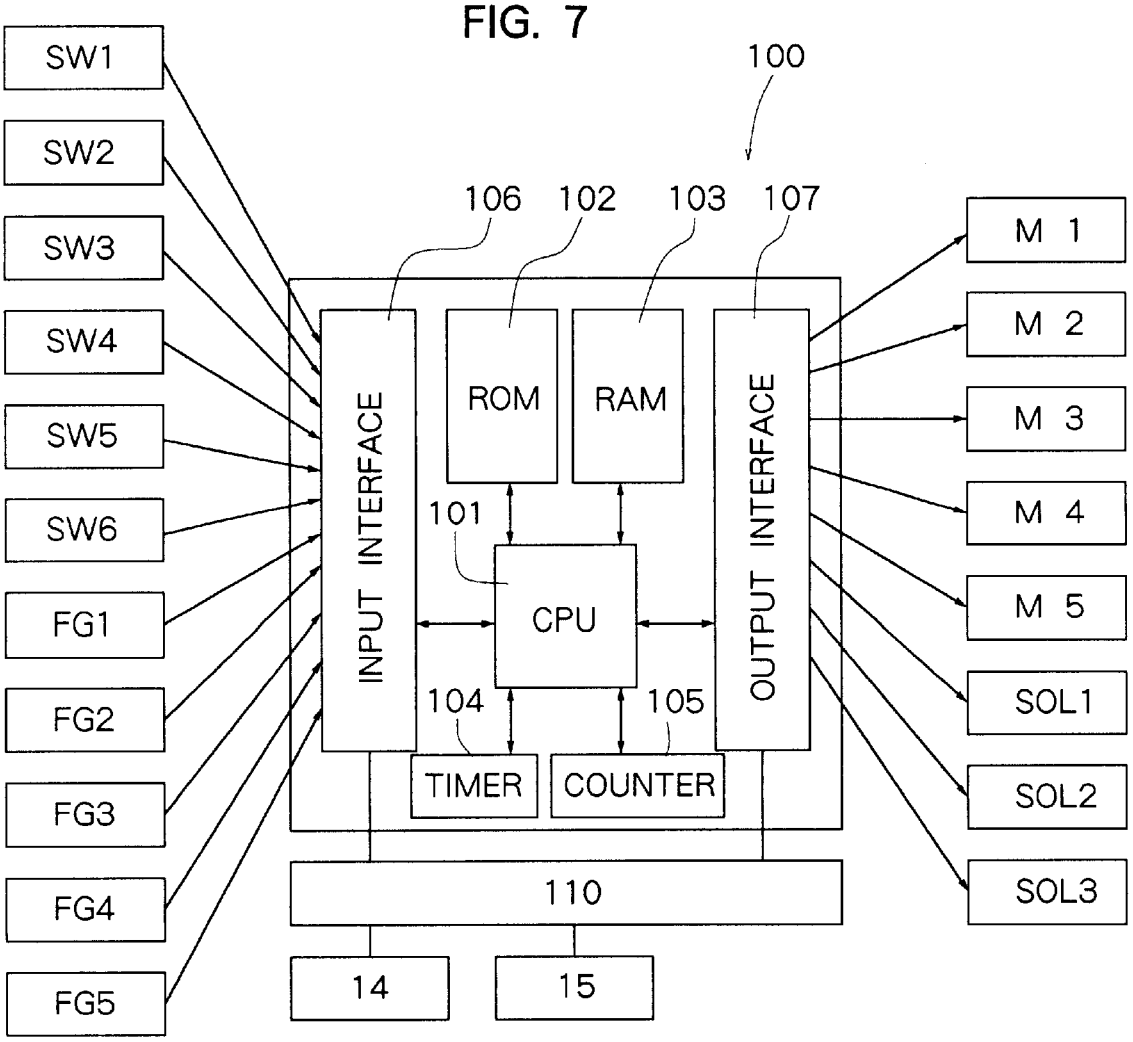
FIG. 7 is a constitution block diagram of control means mounted on the automatic document feeder shown in FIGS. 1 and 2.

The automatic document feeder has control means 100 shown in FIG. 7. The control means 100 is constituted by a microcomputer, and has a central processing unit (CPU) 101 performing arithmetic operations according to a control program, a read-only memory (ROM) 102 storing the control program and a control map, a random access memory (RAM) 103 storing the results of arithmetic operations and being capable of reading and writing, a timer 104, a counter 105, an input interface 106, and an output interface 107. The input interface 106 of the so constituted control means 100 receives detection signals from the presetting switch 35 (SW1), setting switch 36 (SW2), document detectors 74 (SW3), 75 (SW4) and 83 (SW5), home position sensor 95 (SW6), and rotational amount detecting means 281 (FG1), 691 (FG2), 721 (FG3), 821 (FG4) and 941 (FG5). Whereas the output interface 107 puts out control signals to the electric motors 288 (M1), 69 (M2), 72 (M3), 82 (M4) and 94 (M5), and the solenoids 8 (SOL1), 25 (SOL2) and 33 (SOL3). The control means 100 is also connected to control means 110 of the electrostatic copier 2, so that control signals are exchanged between both control means. To the control means 110 of the electrostatic copier 2, the operating means 14 and the display means 15 disposed on the housing 4 are connected. The control means 110 of the electrostatic copier 2 receives copying information entered by the operating keys of the operating means 14, and displays copying information or failure information on the display means 15.

Figure 8:
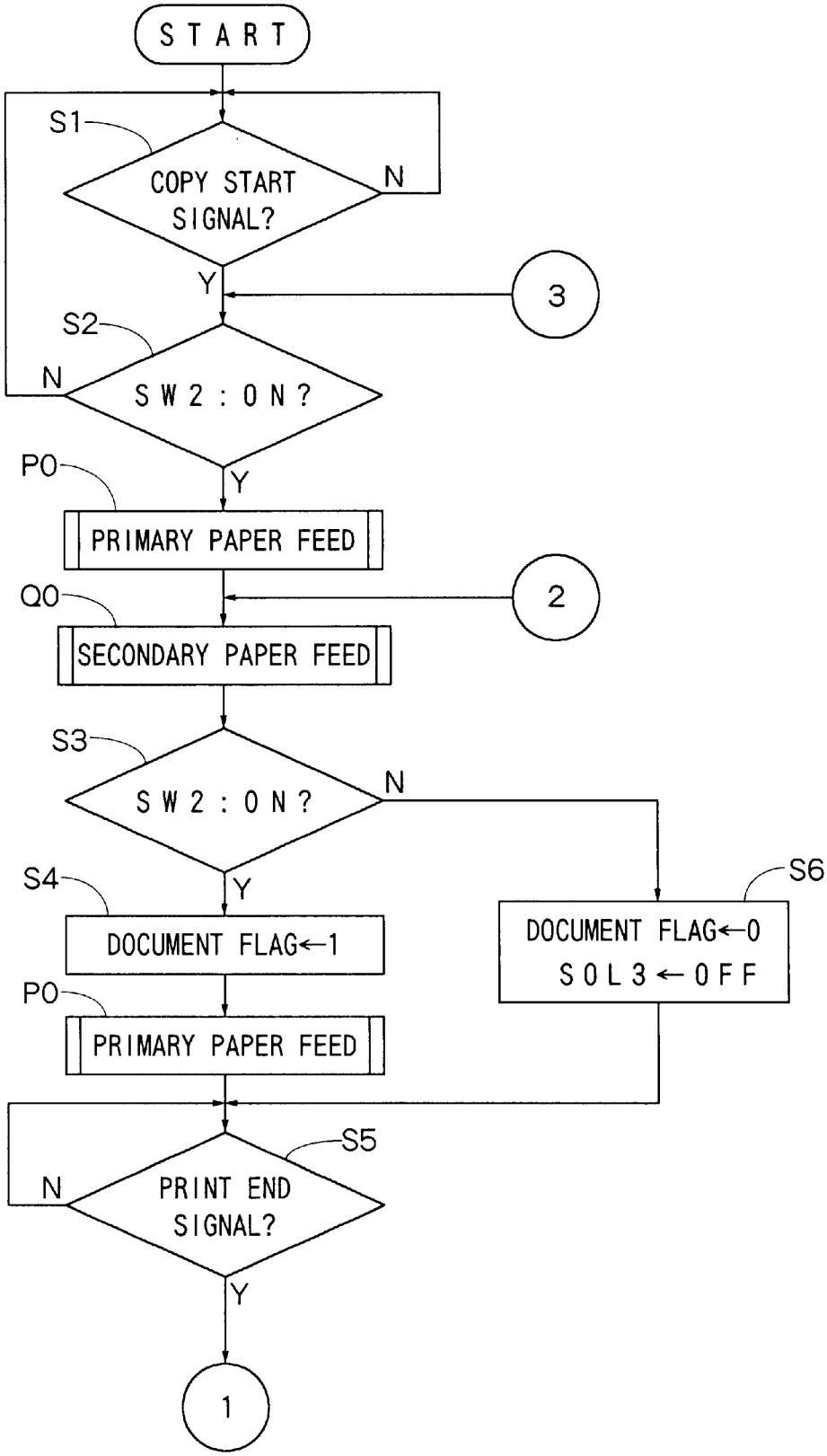
FIG. 8 is a flow chart showing a part of a main routine representing a processing procedure by the control means shown in FIG. 7.
Figure 9:
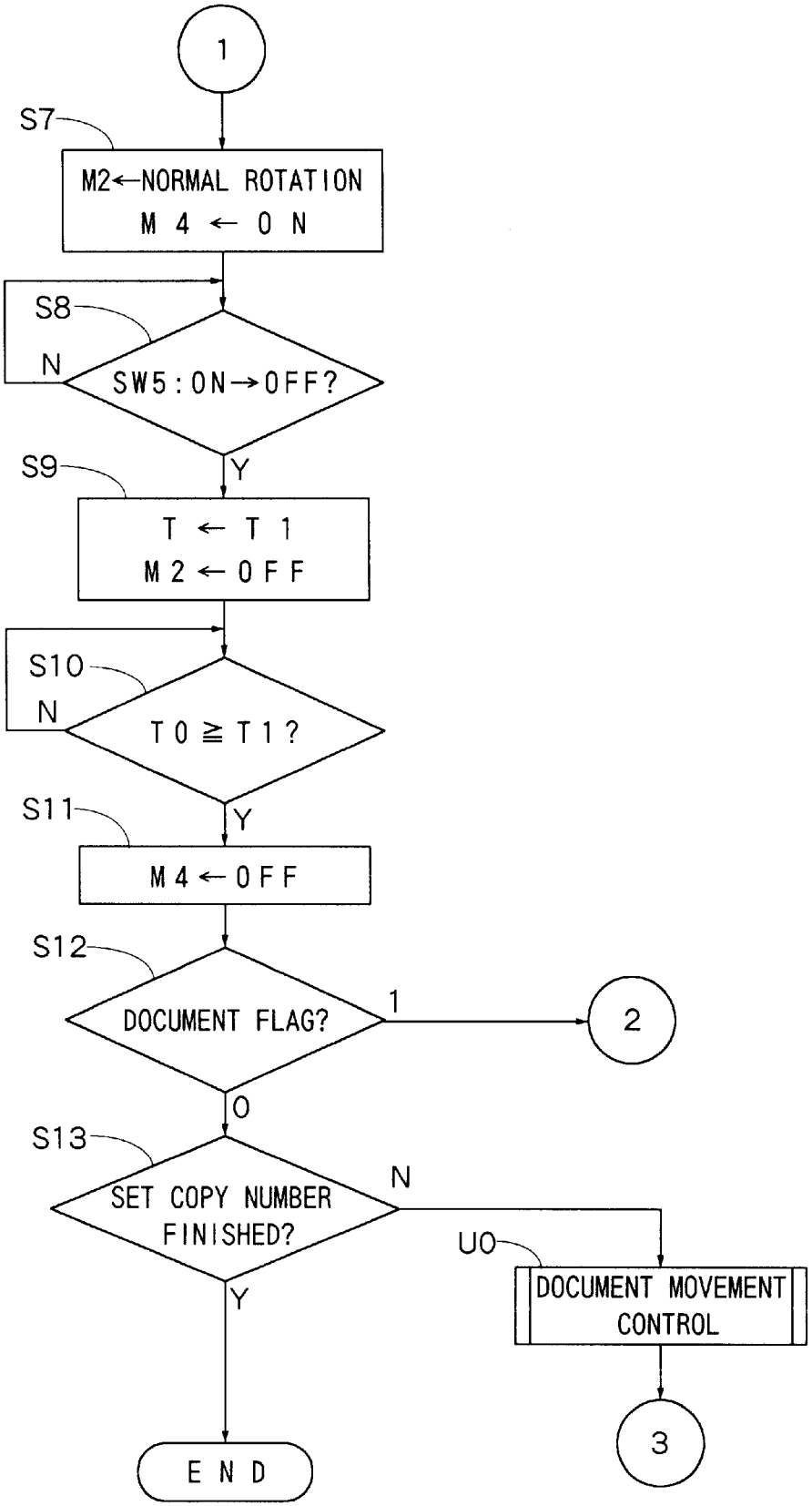
FIG. 9 is a flow chart showing another part of the main routine representing the processing procedure by the control means shown in FIG. 7.
Figure 10:
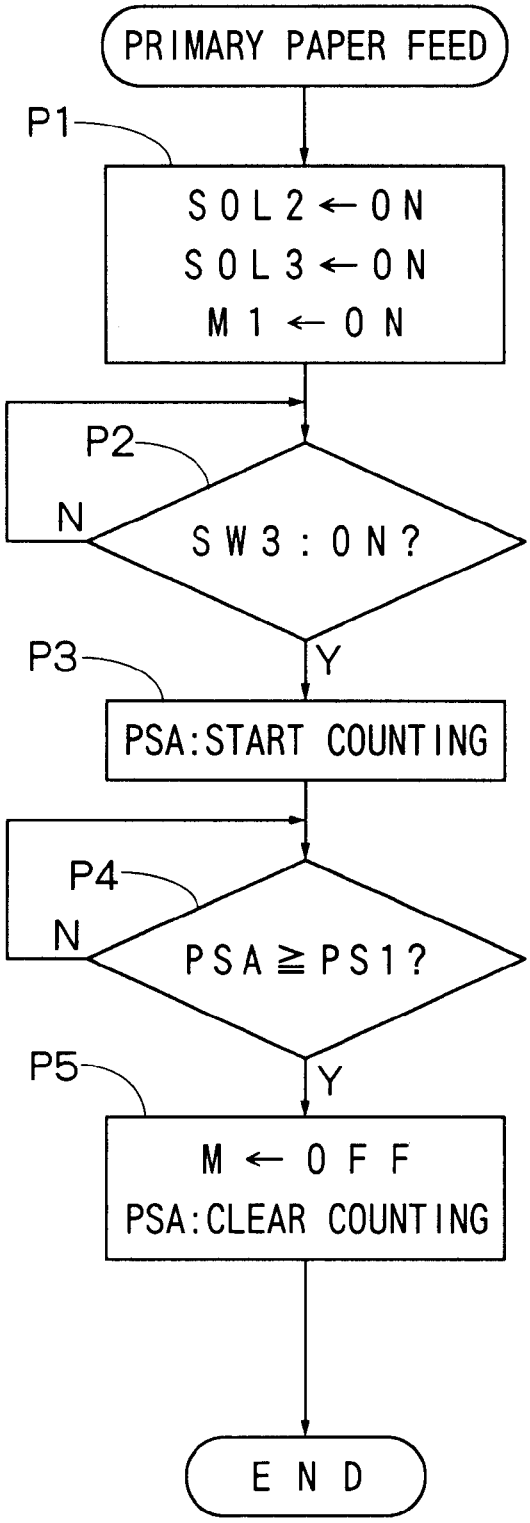
FIG. 10 is a flow chart showing a subroutine for primary paper feed in the processing procedure by the control means shown in FIG. 7.
Figure 11:
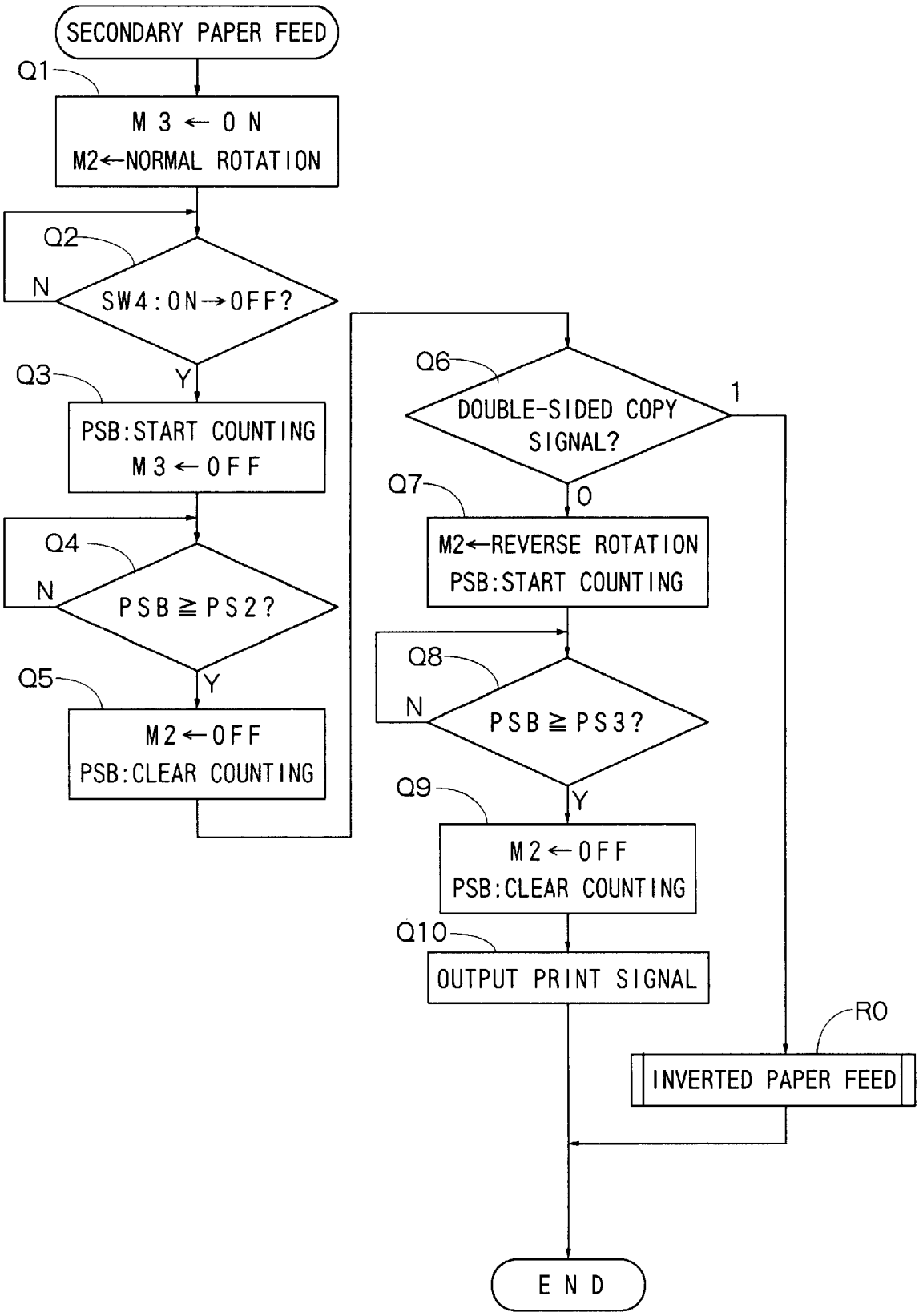
FIG. 11 is a flow chart showing a subroutine for secondary paper feed in the processing procedure by the control means shown in FIG. 7.
Figure 12:
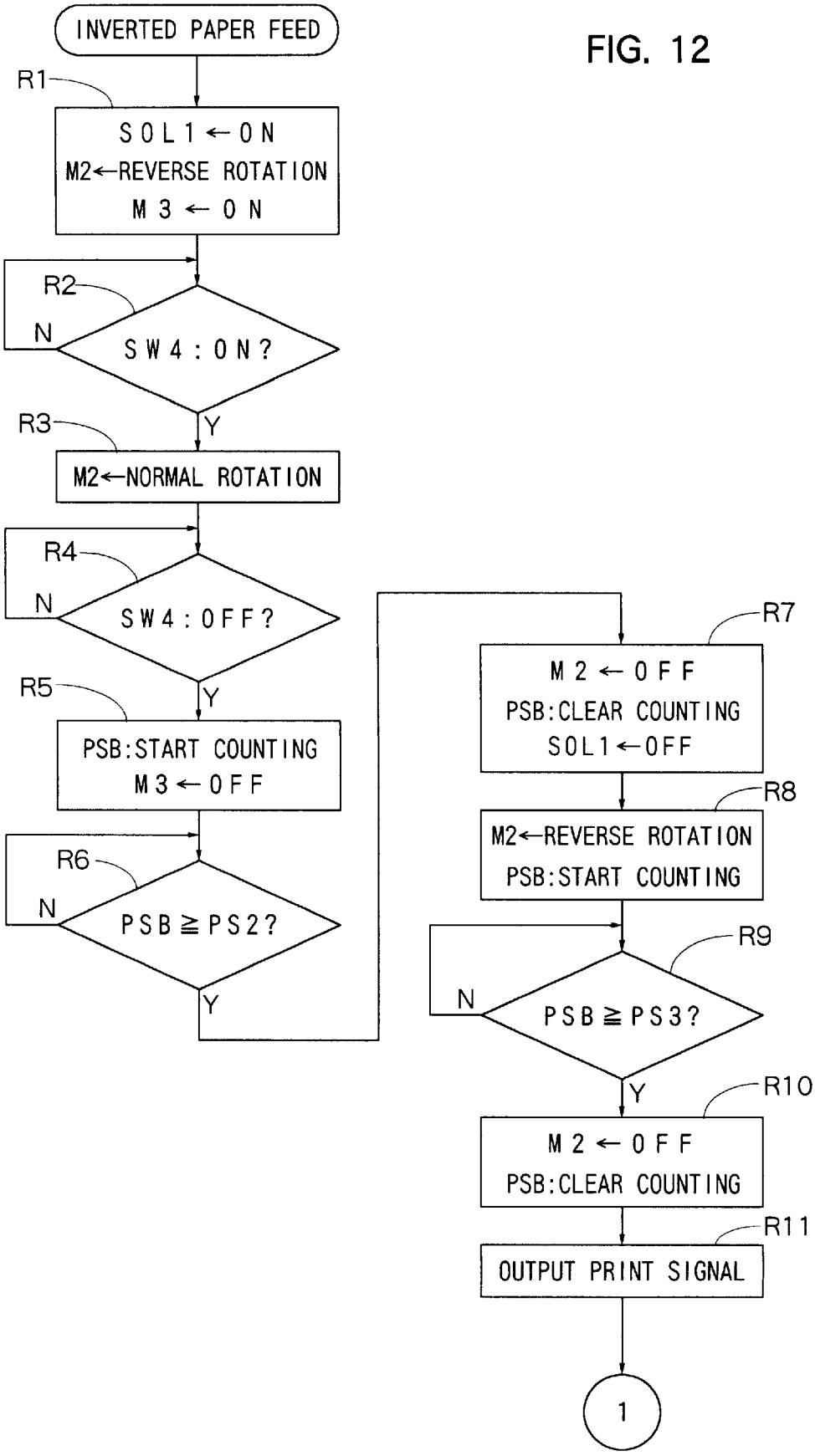
FIG. 12 is a flow chart showing a subroutine for inverted paper feed in the processing procedure by the control means shown in FIG. 7.
Figure 13:
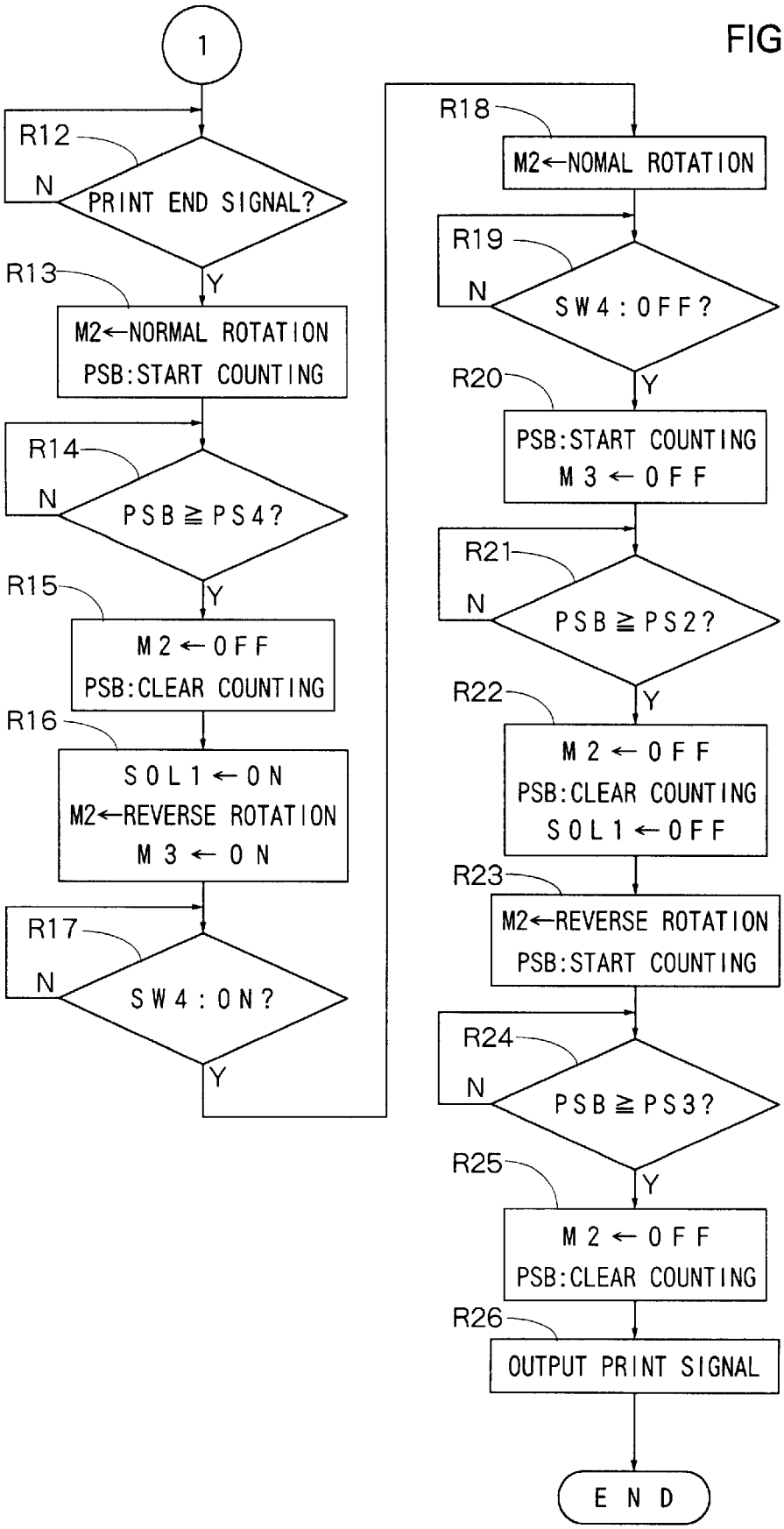
FIG. 13 is a flow chart showing a subroutine for inverted paper feed in the processing procedure by the control means shown in FIG. 7.
Figure 14:
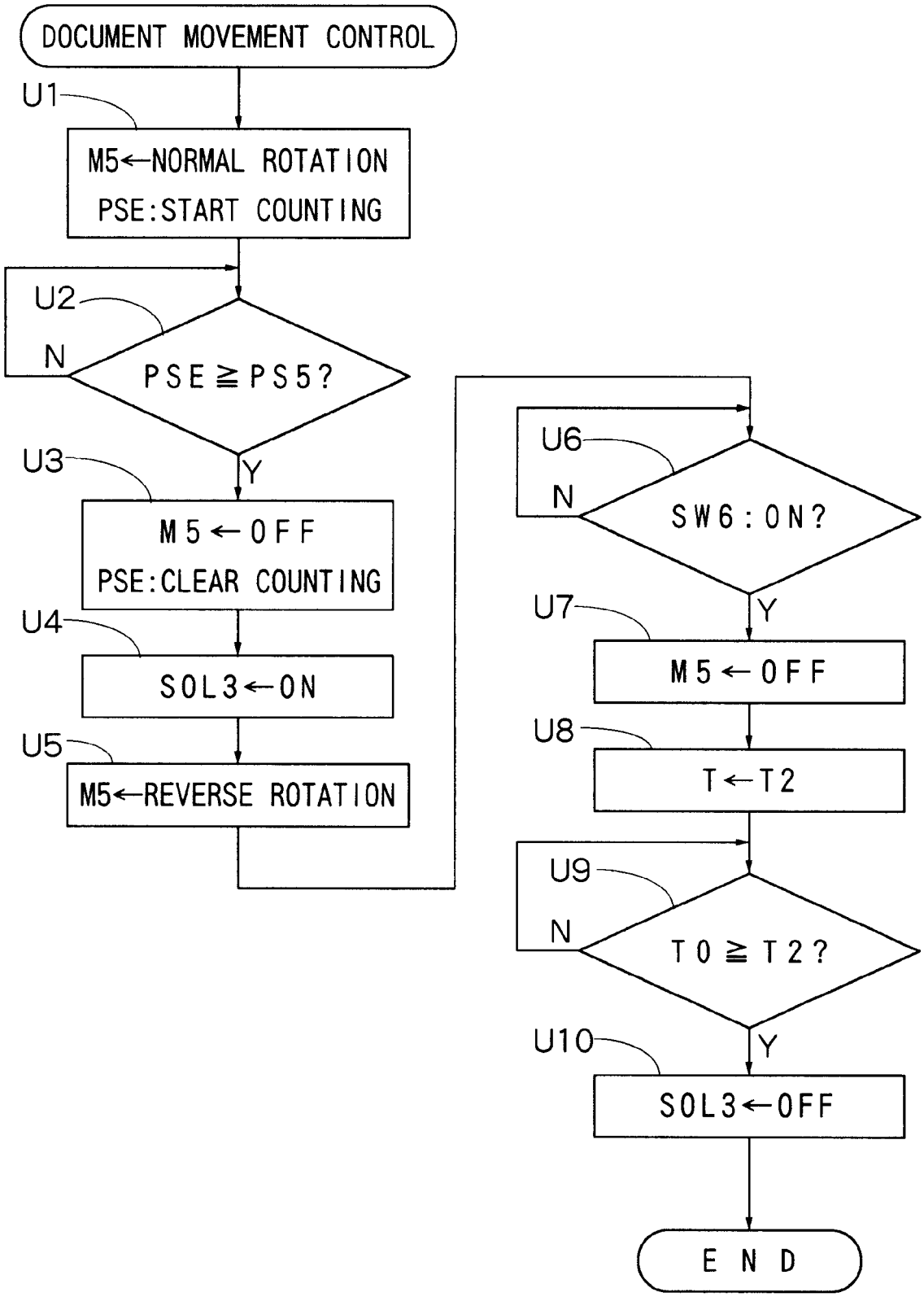
FIG. 14 is a flow chart showing a subroutine for document movement control in the processing procedure by the control means shown in FIG. 7.

The automatic document feeder according to the illustrated embodiment is constituted as described above. The operating procedure for it will be described with reference to flow charts shown in FIGS. 8 to 14. FIGS. 8 and 9 show a main routine, FIG. 10 shows a subroutine for primary paper feed, FIG. 11 shows a subroutine for secondary paper feed, FIGS. 12 and 13 show a subroutine for inverted paper feed, and FIG. 14 shows a subroutine for control of document moving.

In performing a copying operation, a document D to be copied is placed on the document bearing plate 21, with the first page uppermost. On this occasion, the presetting switch 35 (SW1) is turned on. Based on its ON signal, the control means 100 drives the electric motor 28 (M1). Upon the driving of the electric motor 28 (M1), the forwarding rollers 26 and 27 are rotated, whereby the document laid on the document bearing plate 21 is moved toward the downstream side in the document feeding direction (leftward in FIG. 2). When the document moved toward the downstream side in the document feeding direction reaches the setting switch 36 (SW2), the setting switch 36 (SW2) become ON. Its ON signal is sent to the control means 100. The control means 100 stops the driving of the electric motor 28 (M1) when a predetermined period of time has passed since the setting switch 36 (SW2) was turned on. Thus, the document laid on the document bearing plate 21 has its front end contacted with the stopper portion 231 of the document stopper 23, whereupon the document is set at a predetermined document setting position. Once the document is set in this manner, the automatic document feeder works as follows:

In the main routine shown in FIGS. 8 and 9, the control means 100 checks at step S1 whether a copy start signal has been sent by the control means 110 of the electrostatic copier 2. The copy start signal is sent by the control means 110 to the control means 100 when entered by the operator from the copy start key of the operating means 14. No receipt of the copy start signal means no need for copying, and results in the wait state. Upon receipt of the copy start signal at step S1, the control means 100 goes to step S2, checking whether the setting switch 36 (SW2) is ON, i.e., whether a document has been placed at the document setting position of the document bearing plate 21. If the setting switch 36 (SW2) is not ON, a judgment is made that no document has been placed at the document setting position of the document bearing plate 21. Thus, the procedure returns to step S1. When the setting switch 36 (SW2) is ON at step S2, a judgment is made that a document has been placed at the document setting position of the document bearing plate 21. The control means 100 goes to step P0, performing a subroutine for primary paper feed. Upon receipt of the copy start signal, the control means 100 drives driving means (not shown), moving the partition unit 37, as shown by the two-dot chain line, from the home position shown by the solid line in FIG. 2 toward the upstream side in the document feeding direction (rightward in FIG. 2) over a distance corresponding to the size of the document set on the document bearing plate 21. Then, the control means 100 energizes a solenoid (not shown) to bring the partition member 39 into an operative state.

Next, a subroutine for primary paper feed shown in FIG. 10 will be described. The control means 100 energizes the solenoid 25 (SOL2) and the solenoid 33 (SOL3), and also drives the electric motor 28 (M1), at step P1. By the energizing of the solenoid 25 (SOL2), the document stopper 23 is brought to the retreat position. By the energizing of the solenoid 33 (SOL3), the pressing plate 32 of the document pressing means 30 is brought to the pressing position. When the pressing plate 32 comes to the pressing position, the pressing plate 32 acts on the top of the uppermost document of the documents placed on the document bearing plate 21 to exert a pressure on the documents. When the electric motor 28 (M1) is driven, the forwarding rollers 26 and 27 are rotationally driven, whereby the documents placed on the document bearing plate 21 are fed toward the document separating means 42, beginning with the bottommost document. Of the stack of documents fed by the forwarding rollers 26 and 27 toward the document separating means 42, only the bottommost document is separated by the separating action of the separating roller 43 and the separating belt mechanism 44, and supplied into the document sending-in path 40.

After only the bottommost document is separated from the stack of documents placed on the document bearing plate 21 and supplied into the document sending-in path 40, the control means 100 goes to step P2, checking whether the document detector 74 (SW3) is ON, i.e., whether the front end of the document fed into the document sending-in path 40 has arrived at the document detector 74 (SW3). If the document detector 74 (SW3) is not ON at step P2, the control means 100 enters the wait state. When the document detector 74 (SW3) is ON, the control means 100 goes to step P3, starting counting of pulse signals PSA from the rotational amount detecting means 281 (FG1) mounted on the electric motor 28 (M1) that drives the forwarding rollers 26, 27 and separating roller 43. Upon starting the counting of pulse signals PSA at step P3, the control means 100 goes to step P4, checking whether the pulse signals PSA have amounted to the set number of pulses PS1. The set number of pulses PS1 is set at an amount corresponding to the distance of transport slightly longer than the distance from the document detector 74 (SW3) to the site of nip between the inverting/register roller 70 and the register roller 71. If the pulse signals PSA have not reached the set pulse number PS1 at step P4, the control means 100 waits, and continues document transport. If the pulse signals PSA have reached the set pulse number PS1, a judgment is made that the front end of the document has arrived at the site of nip between the inverting/register roller 70 and the register roller 71. Based on this judgment, the control means 100 goes to step P5, stopping the electric motor 28 (M1) and clearing the counting of pulse signals PSA from the rotational amount detecting means 281 (FG1). As a result of this primary paper feed action, the document fed to the document sending-in path 40 by the forwarding rollers 26, 27 and the document separating means 42 has its front end contacted with the nip between the inverting/register roller 70 and the register roller 71 put in the non-operating state. Thus, the first primary paper feed comes to an end.

Returning to the main routine shown in FIGS. 8 and 9, upon completion of primary paper feed as described above, the control means 100 proceeds to step Q0, executing a subroutine for secondary paper feed. The subroutine for secondary paper feed will be described on the basis of FIG. 11. The control means 100, at step Q1, drives the electric motor 72 (M3) and drives the electric motor 69 (M2) for normal rotation. Thus, the inverting/register roller 70 and the conveying belt mechanism 60 are operated, whereby the document carried to the nip between the inverting/register roller 70 and the register roller 71 during the primary paper feed is carried toward the document transport path 68 extending along the transparent platen 5 of the electrostatic copier 2. After driving the electric motor 72 (M3) and driving the electric motor 69 (M2) for normal rotation at step Q1, the control means 100 goes to step Q2, thereby checking whether the document detector 75 (SW4) has become OFF after becoming ON. Namely, the control means 100 checks whether the rear end of the document primarily fed in the above manner and carried toward the document transport path 68 by the operation of the inverting/register roller 70 and the register roller 71 has passed the document detector 75 (SW4). If the document detector 75 (SW4) is not OFF after becoming ON at step Q2, the control means 100 enters the wait state. If the document detector 75 (SW4) is OFF after becoming ON, the control means 100 judges that the rear end of the document has passed the document detector 75 (SW4). Thus, the control means 100 proceeds to step Q3, starting counting of pulse signals PSB from the rotational amount detecting means 691 (FG2) mounted on the electric motor 69 (M2) that drives the driving roller 61 of the conveying belt mechanism 60. At the same time, the control means 100 stops the electric motor 72 (M3). Upon starting the counting of pulse signals PSB at step Q3, the control means 100 goes to step Q4, checking whether the pulse signals PSB have amounted to the set number of pulses PS2. The set number of pulses PS2 is set at an amount corresponding to the distance of transport longer by a predetermined amount than the distance from the document detector 75 (SW4) to the document exposure reference position G. If the pulse signals PSB have not reached the set pulse number PS2 at step Q4, the control means 100 waits, and continues document transport. If the pulse signals PSB have reached the set pulse number PS2, a judgment is made that the rear end of the document conveyed from left to right in FIG. 2 through the document transport path 68 extending along the transparent platen 5 has arrived at a position at which it has overrun the document exposure reference position G rightward in FIG. 2 by a predetermined distance. Based on this judgment, the control means 100 goes to step Q5, stopping the electric motor 69 (M2) and clearing the counting of pulse signals PSB from the rotational amount detecting means 691 (FG2).

Then the control means 100 proceeds to step Q6 to check whether a double-sided copy signal has been received. The double-sided copy signal is entered by the operator into the control means 110 of the electrostatic copier 2 through the double-sided copy designation key of the operating means 14. Based on its input signal, the double-sided copy signal is sent from the control means 110 to the control means 100. If the double-sided copy signal is present at step Q6, the control means 100 goes to step R0, performing a subroutine for inverted paper feed (to be described later on). If there is no double-sided copy signal at step Q6, i.e., when only one side of the document is to be copied, the control means 100 goes to step Q7, reversely driving the electric motor 69 (M2) of the conveying belt mechanism 60, and also starting the counting of pulse signals PSB from the rotational amount detecting means 691 (FG2). By this measure, the conveying belt mechanism 60 is reversely driven, whereby the document carried onto the transparent platen 5 is conveyed from the right to the left in FIG. 2. Upon starting the counting of pulse signals PSB at step Q7, the control means 100 goes to step Q8, checking whether the pulse signals PSB have amounted to the set number of pulses PS3. The set number of pulses PS3 is set at an amount corresponding to the distance of transport from the rear end of the document having overrun as a result of transport of the document to the document exposure reference position G, or a slightly longer distance of transport than it. If the pulse signals PSB have not reached the set pulse number PS3 at step Q8, the control means 100 waits, and continues document transport. If the pulse signals PSB have reached the set pulse number PS3, a judgment is made that the rear end of the document has arrived at the document exposure reference position G, contacting the document positioning member 6. Based on this judgment, the control means 100 goes to step Q9, stopping the electric motor 69 (M2) and clearing the counting of pulse signals PSB from the rotational amount detecting means 691 (FG2). When locating the document at a predetermined document exposure position, the control means goes to step Q10, issuing a print signal, i.e., an exposure ready signal, to the control means 110 of the electrostatic copier 2.

Next, the action during the sending of the double-sided print signal at step Q6 will be described on the basis of the subroutine for inverted paper feed shown in FIGS. 12 and 13. When the inverted paper feed is to be performed, at step Q5 in the aforementioned subroutine for secondary paper feed, the document is located at a position at which it has overrun the document exposure reference position G on the transparent platen 5 rightward in FIG. 2 by a predetermined distance.

At step R1, the control means 100 energizes the solenoid 8 (SOL1), reversely drives the electric motor 69 (M2), and drives the electric motor 72 (M3). Upon energizing of the solenoid 8 (SOL1), the document positioning member 6 is brought to the retreat position. When the electric motor 69 (M2) is reversely driven, and the electric motor 72 (M3) is driven, the conveying belt mechanism 60 is reversely actuated, and the inverting/register roller 70 is rotated. As a result, the document positioned on the transparent platen 5 is sent from the right to the left in FIG. 2, and transported along the document inverting path 73. The document sent from a position on the transparent platen 5 toward the document inverting path 73 is conveyed along the document inverting path 73, whereby the document is turned upside down, and fed into the document sending-in path 40. After sending the document positioned on the transparent platen S toward the document inverting path 73 in this manner, the control means 100 goes to step R2, checking whether the document detector 75 (SW4) is ON, i.e., whether the front end of the document has arrived at the document detector 75 (SW4). If the document detector 75 (SW4) is not ON, the control means 100 enters the wait state. When the document detector 75 (SW4) is ON, the control means 100 judges that the front end of the document has arrived at the document detector 75 (SW4). Based on this judgment, the control means 100 goes to step R3, driving the electric motor 69 (M2) for normal rotation. Then, the control means 100 proceeds to step R4, checking whether the document detector 75 (SW4) is OFF, i.e., whether the rear end of the document has passed the document detector 75 (SW4). If the document detector 75 (SW4) is not OFF, the control means 100 enters the wait state. When the document detector 75 (SW4) is OFF, the control means 100 judges that the rear end of the document has passed the document detector 75 (SW4). Based on this judgment, the control means 100 goes to step R5, starting the counting of pulse signals PSB from the rotational amount detecting means 691 (FG2) mounted on the electric motor 69 (M2) that drives the conveying belt mechanism 60. At the same time, the control means 100 stops the electric motor 72 (M3). After starting the counting of the pulse signals PSB at step R5, the control means 100 goes to step R6 to check whether the pulse signals PSB have reached the set number of pulses PS2. If the pulse signals PSB have not reached the set pulse number PS2 at step R6, the control means 100 waits, and continues document transport. If the pulse signals PSB have reached the set pulse number PS2, a judgment is made that the rear end of the document conveyed from left to right in FIG. 2 through the document transport path 68 extending along the transparent platen 5 has arrived at a position at which it has overrun the document exposure reference position G rightward in FIG. 2 by a predetermined distance. Based on this judgment, the control means 100 goes to step R7, stopping the electric motor 69 (M2) and clearing the counting of pulse signals PSB from the rotational amount detecting means 691 (EG2). At the same time, the control means 100 deenergizes the solenoid 8 (SOL1) to bring the document positioning member 6 at the operating position.

Then, the control means 100 proceeds to step R8, reversely driving the electric motor 69 (M2) for the conveying belt mechanism 60, and starts the counting of pulse signals PSB from the rotational amount detecting means 691 (FG2). By this measure, the conveying belt mechanism 60 is reversely driven, whereby the document carried onto the transparent platen 5 is conveyed from the right to the left in FIG. 2. Upon starting the counting of pulse signals PSB at step R8, the control means 100 goes to step R9, checking whether the pulse signals PSB have amounted to the set number of pulses PS3. If the pulse signals PSB have not reached the set pulse number PS3 at step R9, the control means 100 waits, and continues document transport. If the pulse signals PSB have reached the set pulse number PS3, a judgment is made that the rear end of the document has arrived at the document exposure reference position G, contacting the document positioning member 6. Based on this judgment, the control means 100 goes to step R10, stopping the electric motor 69 (M2) and clearing the counting of pulse signals PSB from the rotational amount detecting means 691 (FG2). In this manner, the back of the document is put to a predetermined document exposure position. Then, the control means 100 goes to step R11, issuing a print signal, i.e., an exposure ready signal, to the control means 110 of the electrostatic copier 2.

After issuing the print signal to the control means 110 of the electrostatic copier 2, the control means 100 proceeds to step R12, checking whether a print end signal has been received from the control means 110 of the electrostatic copier 2. That is, the control means 100 checks whether exposure has been completed for the back of the document located at the predetermined setting position by performing the procedure until step R10. If no print end signal has been received at step R12, the control means 100 waits. Upon receipt of the print end signal, a judgment is made that the exposure of the back of the document has been completed. Thus, the control means 100 goes to step R13 and later steps, performing an action for bringing the face of the document having completed the exposure of the back to the predetermined setting position in the above described manner.

In changing the back of the document to its face, the control means 100 drives the electric motor 69 (M2) for normal rotation at step R13, and simultaneously starts the counting of pulse signals PSB from the rotational amount detecting means 691 (FG2). By the driving of the electric motor 69 (M2) for normal rotation, the conveying belt mechanism 60 is driven for normal rotation, whereby the document located at the predetermined setting position on the transparent platen 5 is conveyed from the left to the right in FIG. 2. Upon conveying the document located at the predetermined document exposure position on the transparent platen 5 in a direction away from the document positioning member 6, the control means 100 proceeds to step R14, checking whether the pulse signals PSB have amounted to the set number of pulses PS4. The set pulse number PS4 is set at an amount corresponding to the amount of conveyance enough to withdraw the document when the end of the document located at the determined document exposure position on the transparent platen 5 is pinched between the document positioning member 6 and the transparent platen 5. Upon starting the counting of pulse signals PSB at step R13, the control means 100 goes to step R14, checking whether the pulse signals PSB have amounted to the set number of pulses PS4. If the pulse signals PSB have not reached the set pulse number PS4 at step R14, the control means 100 waits, and continues document transport. If the pulse signals PSB have reached the set pulse number PS4, a judgment is made that the rear end of the document has come rightward in FIG. 2 by a predetermined amount away from the document positioning member 6. Based on this judgment, the control means 100 goes to step R15, stopping the electric motor 69 (M2) and clearing the counting of pulse signals PSB from the rotational amount detecting means 691 (FG2). Since the rear end of the document is thus separated from the document positioning member 6, the document can be withdrawn reliably, even when the end of the document is pinched between the document positioning member 6 and the transparent platen 5. Nor is the rear end of the document pinched between the document positioning member 6 and the transparent platen 5 because of the downward movement of the document positioning member 6, when the document positioning member 6 is brought to the retreat position prior to the inversion of the document. After the rear end of the document is thus separated from the document positioning member 6 by a predetermined amount, the control means 100 performs steps R16 to R25, thereby inverting the document to put its face to the predetermined document exposure position on the transparent platen 5. These steps R16 to R25 are substantially the same as the aforementioned steps R1 to R10. After performing steps R16 to R25 to invert the document, putting its face to the predetermined document exposure position on the transparent platen 5, the control means 100 proceeds to step R26, issuing a print signal, i.e., an exposure ready signal, to the control means 110 of the electrostatic copier 2.

Returning to the main flow of FIGS. 8 and 9, a description will be offered. After performing the primary paper feed subroutine P0, secondary paper feed subroutine Q0 and inverted paper feed subroutine R0, the control means 100 checks at step S3 whether the setting switch 36 (SW2) is ON, i.e., whether any documents are left on the document bearing plate 21. When the setting switch 36 (SW2) is ON, the control means 100 goes to step S4, setting a document flag and performing the primary paper feed subroutine P0 again. The primary paper feed subroutine P0 is carried out while the face of the document conveyed onto the transparent platen 5 in the preceding turn is being exposed. After executing the primary paper feed subroutine P0 again, the control means 100 proceeds to step S5, checking whether a print end signal has been received from the control means 110 of the electrostatic copier 2. This print end signal is sent from the control means 110 of the electrostatic copier 2 to the control means 100 when the exposure of the face of the document conveyed onto the transparent platen 5 at a preceding time is completed. If the setting switch 36 (SW2) is not ON at step S3, the control means 100 judges that no documents to be copied are left on the document bearing plate 21. Thus, the control means 100 goes to step S6, clearing the document flag, and deenergizing the solenoid 33 (SOL3) to bring the pressing plate 32 of the document pressing means 30 to the retreat position indicated by the solid line in FIG. 2. Then, the control means 100 moves to step S5.

Figure 5:
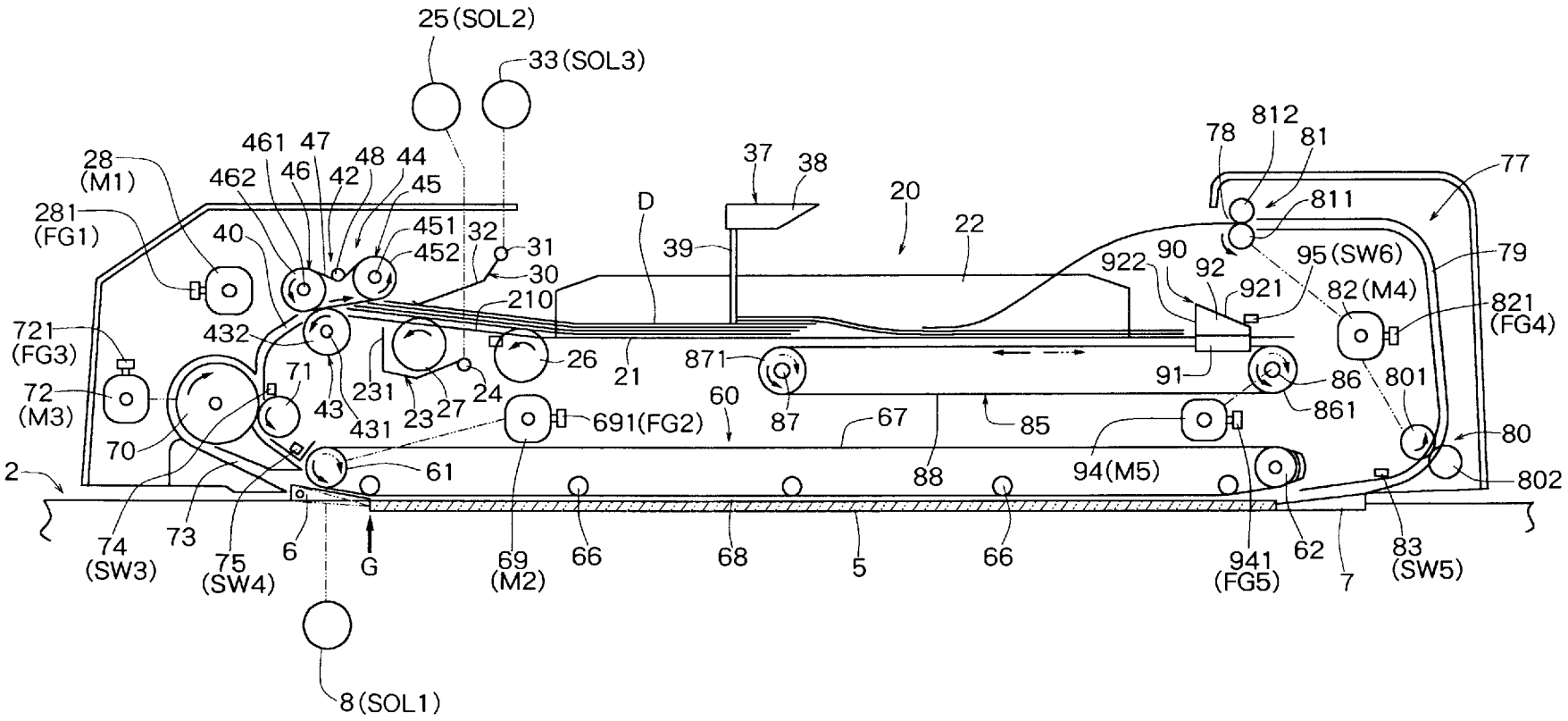
FIG. 5 is an explanatory drawing showing a state in which a fed document has been returned to a document bearing plate of the automatic document feeder illustrated in FIG. 1.

At step S5, the control means 100 waits when no print end signal has been received from the control means 110 of the electrostatic copier 2, or performs a document discharge action when a print end signal has been received. That is, the control means 100 drives the electric motor 69 (M2) for normal rotation at step S7, and also drives the electric motor 82 (M4). When the electric motor 69 (M2) is driven for normal rotation, and the electric motor 82 (M4) is also driven, the conveying belt mechanism 60 is driven for normal rotation, and the document conveying roller pair 80 and document discharge roller pair 81 are actuated. As a result, the document positioned on the transparent platen 5 as described above is conveyed into the document sending-out path 79, and further carried toward the document exit 78 by the document conveying roller pair 80 and document discharge roller pair 81. After driving the electric motor 69 (M2) for normal rotation, and also driving the electric motor 82 (M4), the control means 100 proceeds to step S8, checking whether the document detector 83 (SW5) has become OFF after becoming ON. Namely, the control means 100 checks whether the rear end of the document carried from a position on the transparent platen 5 into the document sending-out path 79 has passed the document detector 83 (SW5). If the document detector 83 (SW5) is not OFF after becoming ON at step S8, the control means 100 enters the wait state. If the document detector 83 (SW5) is OFF after becoming ON, the control means 100 judges that the rear end of the document has passed the document detector 83 (SW5). Thus, the control means 100 proceeds to step S9, setting the timer T at T1. The set time T1 is set at a time taken from the document having passed the document detector 83 (SW5) until it is discharged through the document exit 78 onto the document bearing plate 21. At step S9, the control means 100 also stops the electric motor 69 (M2) that drives the conveying belt mechanism 60. Then, the control means 100 proceeds to step S10, checking whether an elapsed time T0 since the setting of the timer T at T1 has reached the set time T1. If the elapsed time T0 has not reached the set time T1, the control means 100 waits and continues document transport. If the elapsed time T0 has reached the set time T1, a judgment is made that the document has been discharged onto the document bearing plate 21. Thus, the control means 100 goes to step S11, stopping the electric motor 82 (M4) that drives the document conveying roller pair 80 and document discharge roller pair 81. The document returned onto the document bearing plate 21 in the above manner has its front end brought into contact with the partition member 39 of the partition unit 37 located at the middle of the document bearing plate 21, as shown in FIG. 5. Thus, the document placed on the document bearing plate 21 is aligned with the preceding documents and distinguished from documents that have not been fed.

After the document positioned on the transparent platen 5 and finishing the exposure is discharged onto the document bearing plate 21, the control means 100 proceeds to step S12, checking whether a document flag is ON. If a document flag has been set, primary paper feed has already been performed. Thus, the control means 100 moves to step Q0, performing a secondary paper feed action. If no document flag has been set at step S12, this means that no documents to be copied are left on the document bearing plate 21, nor has primary paper feed been performed. Thus, the control means 100 proceeds to step S13, checking whether the set number of copies have finished copying. If step S13 shows completion of copying of the set number of copies, the procedure comes to an end. If the set number of copies is unfinished, the control means 100 goes to step U0, performing document movement control and then moving to step S2.

Next will follow an explanation for a document moving action based on a document movement subroutine shown in FIG. 14. After the document is returned onto the document bearing plate 21 in the above manner, the control means 100 brings the partition member 39 of the partition unit 37, which the front end of the document contacts, to the non-operating position.

Figure 6:
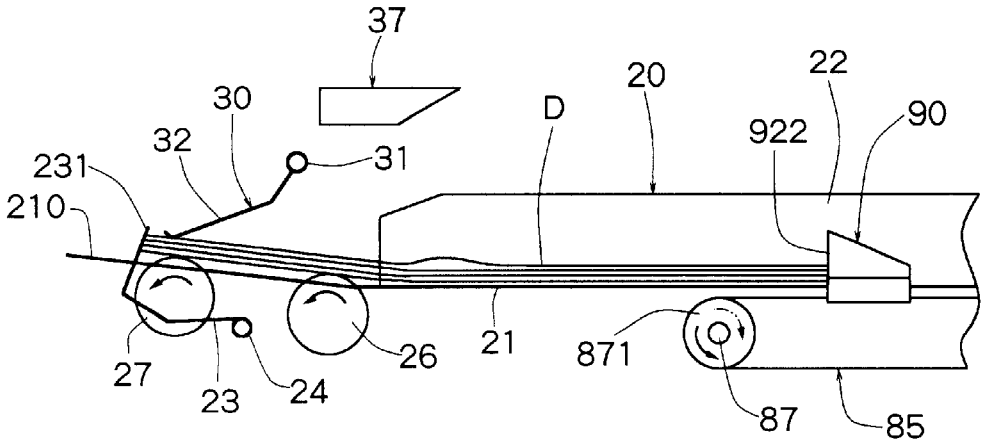
FIG. 6 is an explanatory drawing showing a state in which the document returned to the document bearing plate of the automatic document feeder illustrated in FIG. 1 has been moved to a document setting position by document moving means.

Then, the control means 100 drives the electric motor 94 (M5) for normal rotation at step U1. When the electric motor 94 (M5) is driven for normal rotation, the driving shaft 86 of the document moving means 85 is rotationally driven in the direction shown by the solid arrow, whereby the endless moving belt 88 is actuated in the direction shown by the solid arrow. Thus, the moving plate 90 fixed to the endless moving belt 88 and located at the receding position (home position) shown by the solid line in FIG. 2 moves leftward in FIG. 2. As a result, the pressing surface 922 constituting the a document moving portion 92 of the moving plate 90 contacts the rear end of the document returned onto the document bearing plate 21, thereby moving this document toward the aforementioned setting position. The control means 100 also starts counting of pulse signals PSE from the rotational amount detecting means 941 (FG5) mounted on the electric motor 94 (M5) at step U1. After starting the counting of the pulse signals PSE at step U2, the control means 100 goes to step U2 to check whether the pulse signals PSE have reached the set number of pulses, PS5. The set number of pulses PS5 is set to correspond to the size of the document returned onto the document bearing plate 21. If the pulse signals PSE have not reached the set pulse number PS5 at step U2, the control means 100 enters the wait state, and continues document movement. If the pulse signals PSE have reached the set pulse number PS5, a judgment is made that the document has been moved to the setting position. Based on this judgment, the control means 100 proceeds to step U3, stopping the electric motor 94 (M5) and clearing the counting of the pulse signals PSE from the rotational amount detecting means 941 (FG5). When the document returned onto the document bearing plate 21 has been moved to the setting position, its front end is caused to contact the stopper portion 231 of the document stopper 23, as shown in FIG. 6. At this time, the stopper portion 231 is formed to be inclined toward the upstream side in the document feeding direction, with its upper end coming foremost. Thus, the documents laid upward are warped.

After the document returned onto the document bearing plate 21 has been moved to the predetermined setting position, the control means 100 proceeds to step U4, energizing the solenoid 33 (SOL3), thereby bringing the pressing plate 32 of the document pressing means 30 to the pressing position as shown in FIG. 7. By this measure, the pressing plate 32 acts on the upper surface of the document moved to the predetermined setting position, thereby pressing the document. Then, the control means 100 goes to step U5, reversely driving the electric motor 94 (M5). Upon the reverse driving of the electric motor 94 (M5), the driving shaft 86 of the document moving means 85 is rotationally driven in the direction indicated by the dashed arrow, whereby the endless moving belt 88 is actuated in the direction indicated by the dashed arrow. Thus, the moving plate 90 fixed to the endless moving belt 88 moves rightward in FIG. 2, i.e., toward the receding position (home position). When the moving plate 90 has thus been moved toward the home position upon the reverse driving of the electric motor 94 (M5), the control means 100 goes to step U6, checking whether the home position sensor 95 (SW6) is ON. If the home position sensor 95 (SW6) is not ON, the receding action of the moving plate 90 is continued. If the home position sensor 95 (SW6) is ON, the control means 100 judges that the moving plate 90 has arrived at the home position. Thus, the control means 100 goes to step U7, stopping the electric motor 94 (M5), and clearing the counting of pulse signals PSE from the rotational amount detecting means 941 (FG5). Then, the control means 100 goes to step U8, setting the timer T at T2. The set time T2 is set at a length of time, e.g., 1 sec, during which air between the documents of the document stack pressed by the pressing plate 32 at the setting position is removed. Then, the control means 100 proceeds to step U9, checking whether the time T0 that has elapsed since the setting of the timer T at T2 has reached the set time T2. If the elapsed time T0 has not reached the set time T2, the control means 100 waits. If the elapsed time T0 has reached the set time T2, the control means 100 proceeds to step U10, deenergizing the solenoid 33 (SOL3) to release the pressure on the document by the pressing plate 32. After the document returned onto the document bearing plate 21 has thus been moved to the predetermined setting position by the actuation of the document moving means 85, the document pressing means 30 is actuated to bring the pressing plate 32 to the pressing position, thereby pressing the upper surface of the document moved to the setting position. When the moving plate 90 of the document pressing means 85 recedes toward the home position, therefore, the upper document is not displaced. That is, when the document is moved to the setting position by the document moving means 85, its front end contacts the stopper portion 231 of the document stopper 23, as shown in FIG. 6, whereupon the document laid upward is warped When the moving plate 90 of the document moving means 85 recedes in this condition, the document is about to spring because of an elastic force ascribed to the above-mentioned warp, whereupon the upper document tends to be displaced. However, the document moved to the setting position has been pressed by the pressing plate 32 as above, so that it is never displaced. In the illustrated embodiment, the delivery portion 210 on the downstream side in the document feeding direction of the document bearing plate 21 is formed to be inclined upward. With this configuration, if there is air between the documents of the document stack moved to the setting position, the upper document tends to be displaced to the upstream side in the document feeding direction, when the moving plate 90 of the document moving means 85 is receding toward the home position. However, the document is pressed by the pressing plate 32 for a predetermined period of time after the arrival of the moving plate 90 at the home position. Hence, air between the documents is withdrawn during this period, and no displacement of the document occurs.

As noted above, the present invention has been described on the basis of the embodiments in which it is applied to a copier. However, the invention is not restricted to the illustrated embodiments, but can be applied to other document processors such as facsimile machines.

What we claim is:

1. An automatic document feeder comprising document bearing means for bearing documents; document supplying means for supplying the documents set on the document bearing means; a document sending-in path for guiding the document supplied by the document supplying means onto a transparent platen; a register roller pair disposed beside the document sending-in path for temporarily stopping the document carried by the document supplying means and carrying the stopped document toward a position on the transparent platen; document conveying means for conveying the document carried by the register roller pair to a document exposure position on the transparent platen; document inverting means for turning the document conveyed onto the transparent platen upside down, and carrying the inverted document onto the transparent platen through the document sending-in path; a document positioning member disposed between the document sending-in path and the transparent platen and movable between a restraint position at which it protrudes upwardly of the top of the transparent platen, and a retreat position at which it comes downwardly of the top of the transparent platen; positioning member actuating means for bringing the document positioning member to the restraint position and the retreat position; and control means for controlling the document supplying means, the register roller pair, the document conveying means, the document inverting means, and the positioning member actuating means; wherein when the document located at the document exposure position is to be inverted, the control means operates the document conveying means in a predetermined direction to convey the document by a predetermined amount in a direction away from the document positioning member, then operates the positioning member actuating means to bring the document positioning member to the retreat position, and then operates the document conveying means in a direction opposite to the predetermined direction to convey the document to the document inverting means.

* * * * *